US007415993B2

(12) United States Patent
Hay et al.

(10) Patent No.: US 7,415,993 B2
(45) Date of Patent: Aug. 26, 2008

(54) FABRICS WITH MULTI-SEGMENT, PAIRED, INTERCHANGING YARNS

(75) Inventors: Stewart Lister Hay, Bury (GB); Scott Quigley, Bossier City, LA (US)

(73) Assignee: Voith Patent GmbH, Heidenheim (DE)

( * ) Notice: Subject to any disclaimer, the term of this patent is extended or adjusted under 35 U.S.C. 154(b) by 9 days.

(21) Appl. No.: 10/560,066

(22) PCT Filed: Jun. 8, 2004

(86) PCT No.: PCT/EP2004/051056

§ 371 (c)(1),
(2), (4) Date: Apr. 7, 2006

(87) PCT Pub. No.: WO2004/111333

PCT Pub. Date: Dec. 23, 2004

(65) Prior Publication Data

US 2006/0219312 A1 Oct. 5, 2006

(51) Int. Cl.
*D21F 7/08* (2006.01)
*D03D 25/00* (2006.01)

(52) U.S. Cl. ..... 139/383 A; 162/358.2; 162/900

(58) Field of Classification Search ..... 139/383 A; 162/358.2, 348, 900
See application file for complete search history.

(56) References Cited

U.S. PATENT DOCUMENTS 4,501,303 A * 2/1985 Osterberg ..... 139/425 A
4,909,284 A * 3/1990 Kositzke ..... 139/383 A
4,989,647 A * 2/1991 Marchand ..... 139/383 A
5,067,526 A * 11/1991 Herring ..... 139/383 A
5,092,372 A * 3/1992 Fitzka et al. ..... 139/383 A
5,487,414 A * 1/1996 Kuji et al. ..... 139/383 A
5,555,917 A * 9/1996 Quigley ..... 139/383 A (Continued)

FOREIGN PATENT DOCUMENTS

EP 0 269 070 6/1988

(Continued)

OTHER PUBLICATIONS

International Search Report for PCT/EP2004/051056 mailed Feb. 2, 2005.

*Primary Examiner*—Robert Muromoto
(74) *Attorney, Agent, or Firm*—Taylor & Aust, P.C.

(57) ABSTRACT

A composite forming fabric (10) comprising a paper side layer (12) having a paper side surface, a machine side layer (14) having a bottom wear side surface, and a plurality of pairs of first and second intrinsic, interchanging weft binder yarns (16,18,20, . . . 34) for binding together the paper side layer (12) and the machine side layer (14). At least of said plurality of pairs of first and second intrinsic, interchanging weft binder yarns have at least four segments (S1-S4) in the paper side layer (12) within each repeat of the weave pattern in the fabric, and these segments provide an unbroken weft path in the paper side surface. Each of the first and second intrinsic, interchanging weft binder yarns (16,18,20, . . . 34) of each binder pair having at least four segments (S1-S4) in the paper side layer (12) within each repeat of the weave pattern binds to at least one warp yarn (2-20) in the machine side layer (14) vertically underlying one of the segments (S1-S4).

17 Claims, 14 Drawing Sheets

U.S. PATENT DOCUMENTS

| | | | | | |
|---|---|---|---|---|---|
| 5,826,627 | A | | 10/1998 | Seabrook et al. | |
| 5,881,764 | A | * | 3/1999 | Ward | 139/383 A |
| 5,937,914 | A | * | 8/1999 | Wilson | 139/383 A |
| 5,967,195 | A | * | 10/1999 | Ward | 139/383 A |
| 5,983,953 | A | * | 11/1999 | Wilson | 139/383 A |
| 6,123,116 | A | * | 9/2000 | Ward et al. | 139/383 A |
| 6,145,550 | A | * | 11/2000 | Ward | 139/383 A |
| 6,158,478 | A | * | 12/2000 | Lee et al. | 139/383 A |
| 6,237,644 | B1 | * | 5/2001 | Hay et al. | 139/383 A |
| 6,244,306 | B1 | * | 6/2001 | Troughton | 139/383 A |
| 6,745,797 | B2 | * | 6/2004 | Troughton | 139/383 A |
| 6,837,277 | B2 | * | 1/2005 | Troughton et al. | 139/383 A |
| 6,854,488 | B2 | * | 2/2005 | Hay et al. | 139/383 A |
| 6,978,809 | B2 | * | 12/2005 | Quigley | 139/383 A |
| 7,007,722 | B2 | * | 3/2006 | Quigley et al. | 139/383 A |
| 7,195,040 | B2 | * | 3/2007 | Ward | 139/383 A |
| 2004/0118473 | A1 | * | 6/2004 | Hay et al. | 139/383 R |
| 2004/0238063 | A1 | * | 12/2004 | Stone | 139/383 A |
| 2005/0103397 | A1 | * | 5/2005 | Quigley et al. | 139/383 A |
| 2006/0219312 | A1 | * | 10/2006 | Hay et al. | 139/383 A |
| 2006/0219313 | A1 | * | 10/2006 | Gstrein et al. | 139/383 A |
| 2006/0231154 | A1 | * | 10/2006 | Hay | 139/383 A |
| 2006/0249220 | A1 | * | 11/2006 | Barrett et al. | 139/383 A |

FOREIGN PATENT DOCUMENTS

| | | |
|---|---|---|
| EP | 0 794 283 A1 | 9/1997 |
| EP | 1 273 698 | 1/2002 |

* cited by examiner

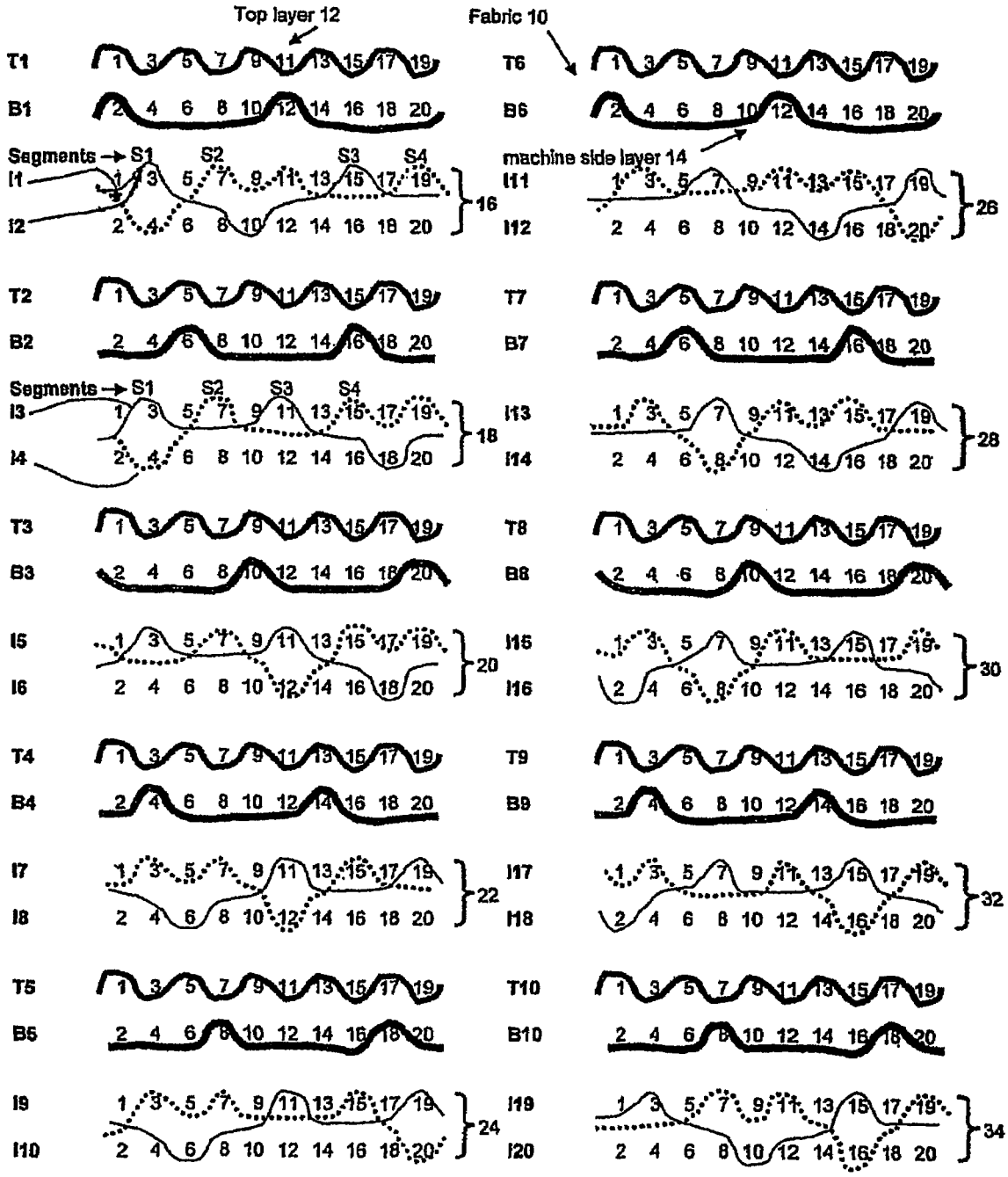
FIG 1-embodiment 1

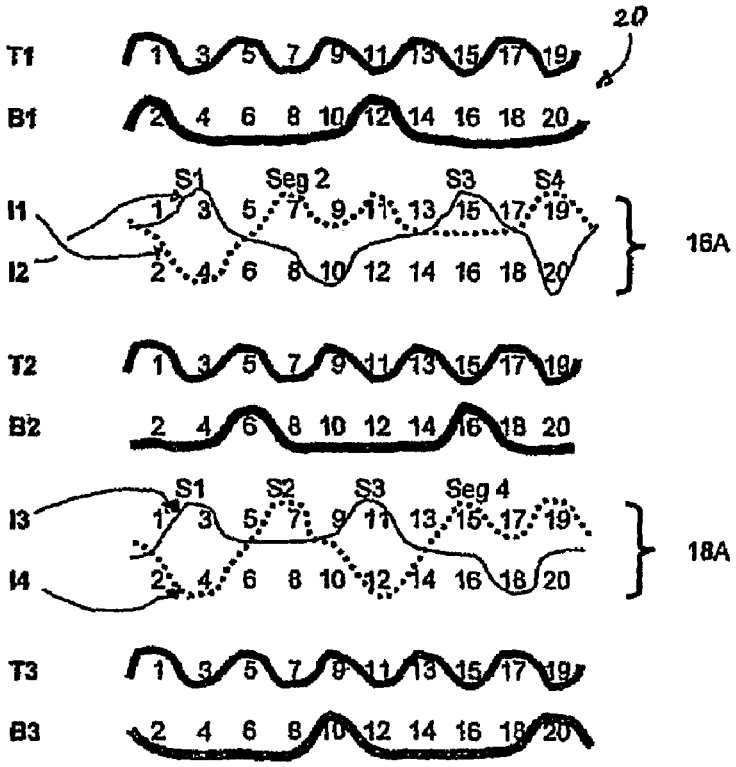
NOT WOVEN ONLY DRAWN FOR PATENT
IF WEAVING THIS - CHECK FOR HOW The 3 WEARSIDE BINDS SHOULD BE DISTRIBUTED
I.E. ALWAYS ON The 2 X'S SINGLE KNUCKLE PAPERSIDE BINDER OR MIXED
FIG 2-embodiment 2

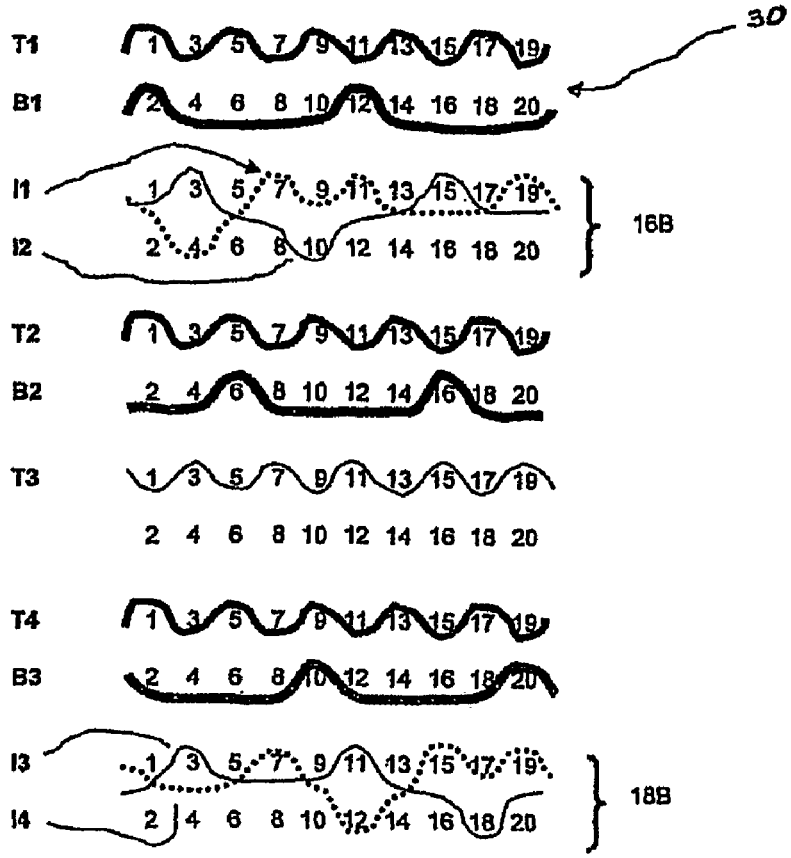
FIG 3-embodiment 3

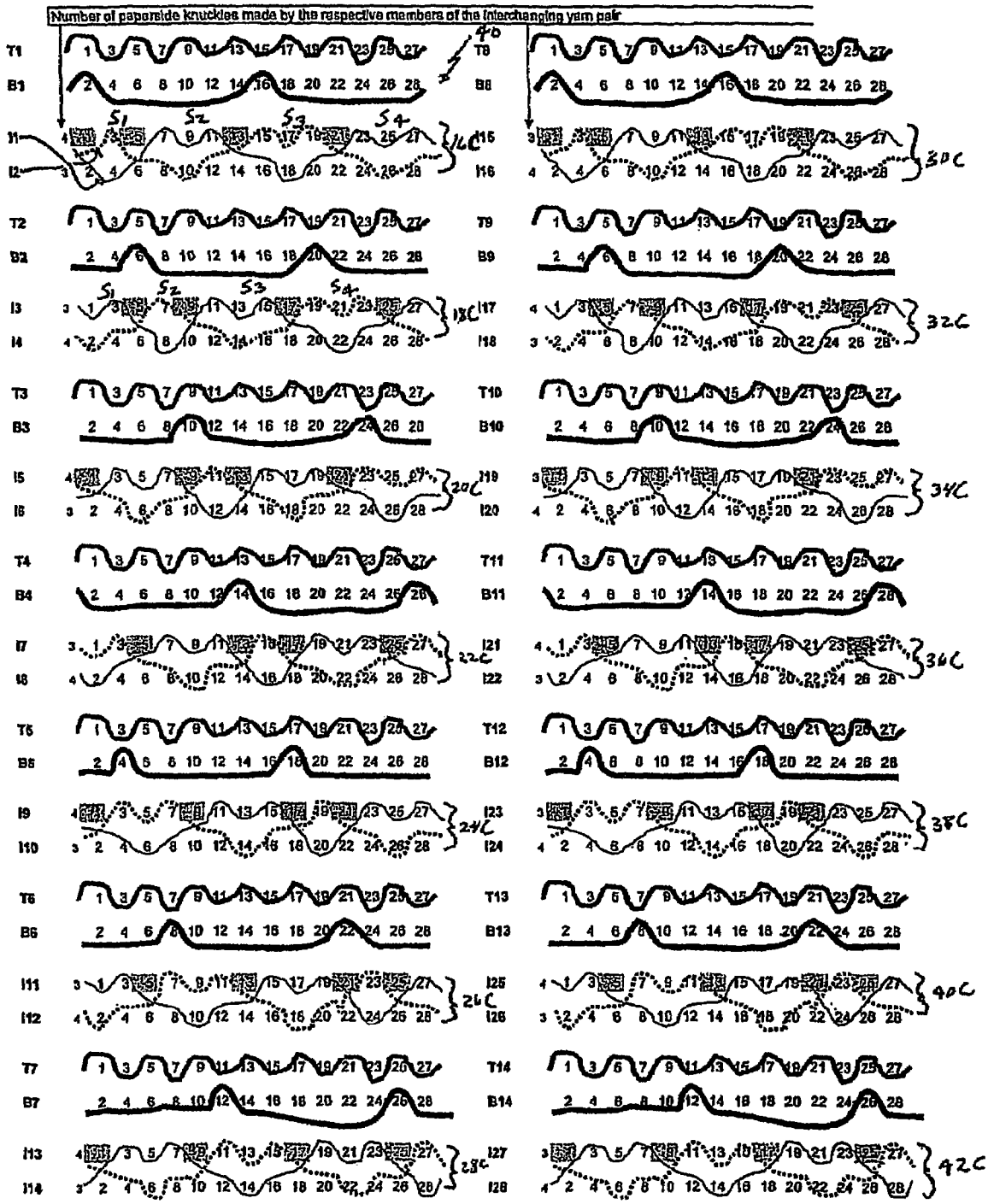
FIG4-Embodiment 4

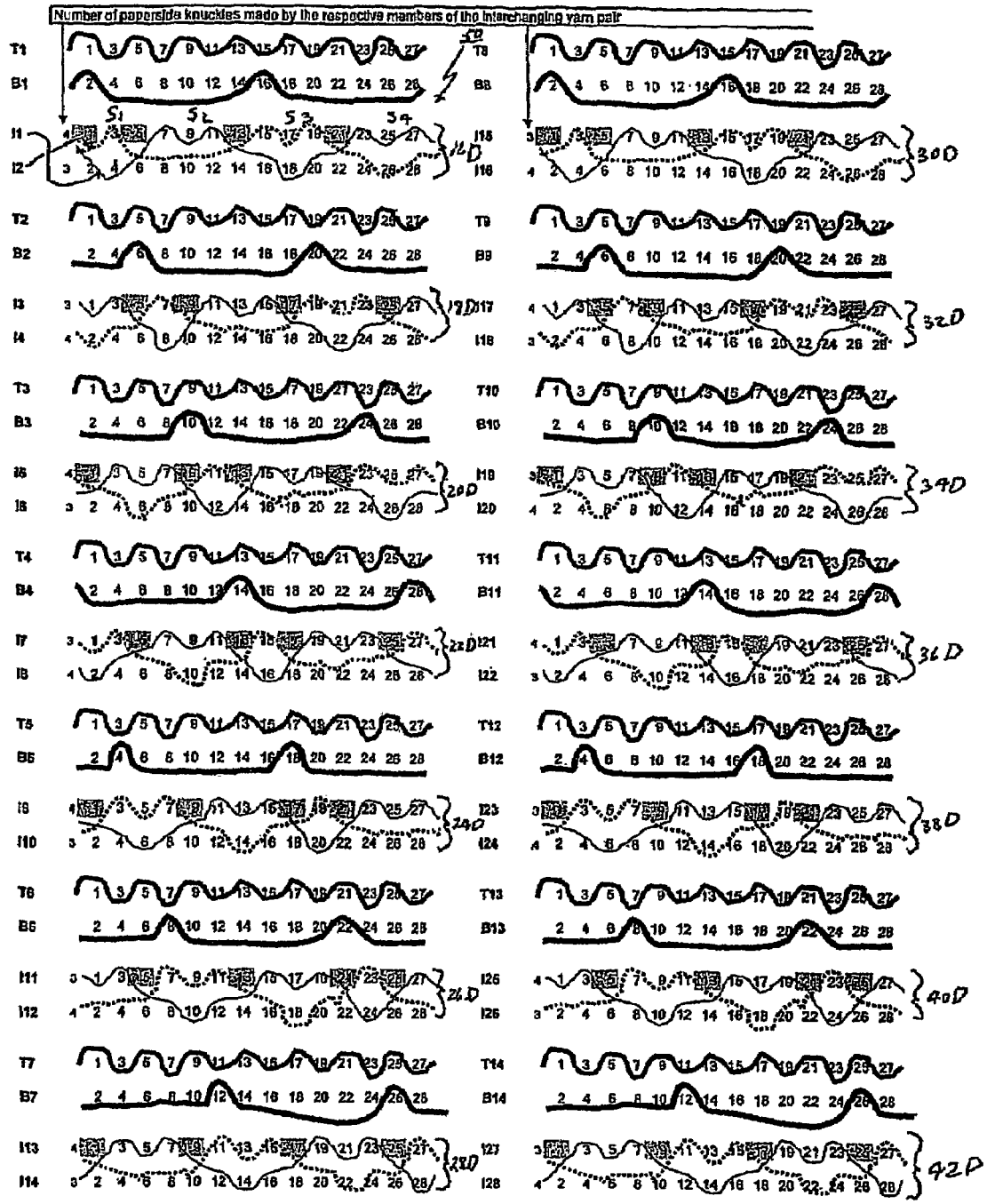
Fig5-embodiment 5

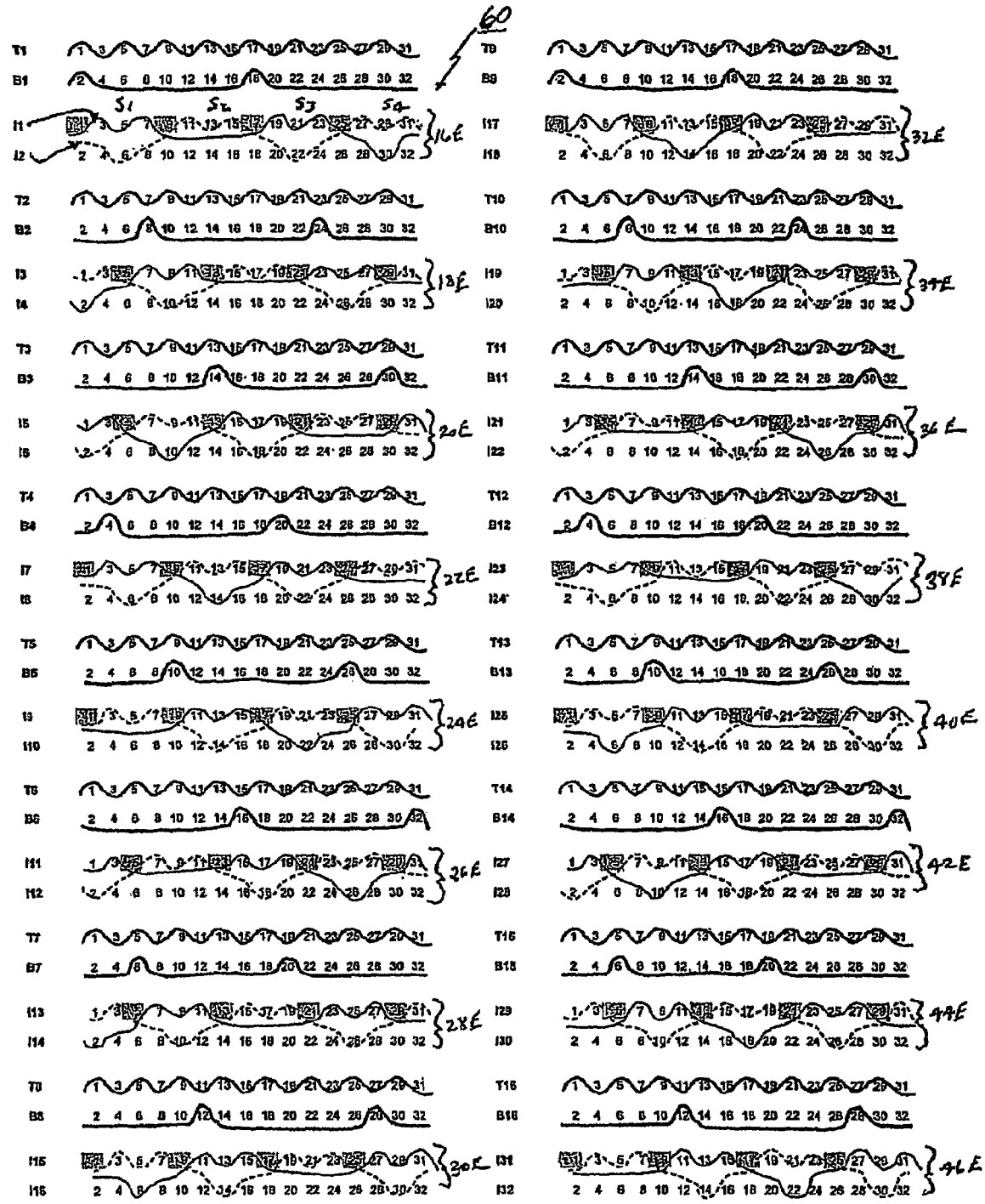
fig6-embodiment 6

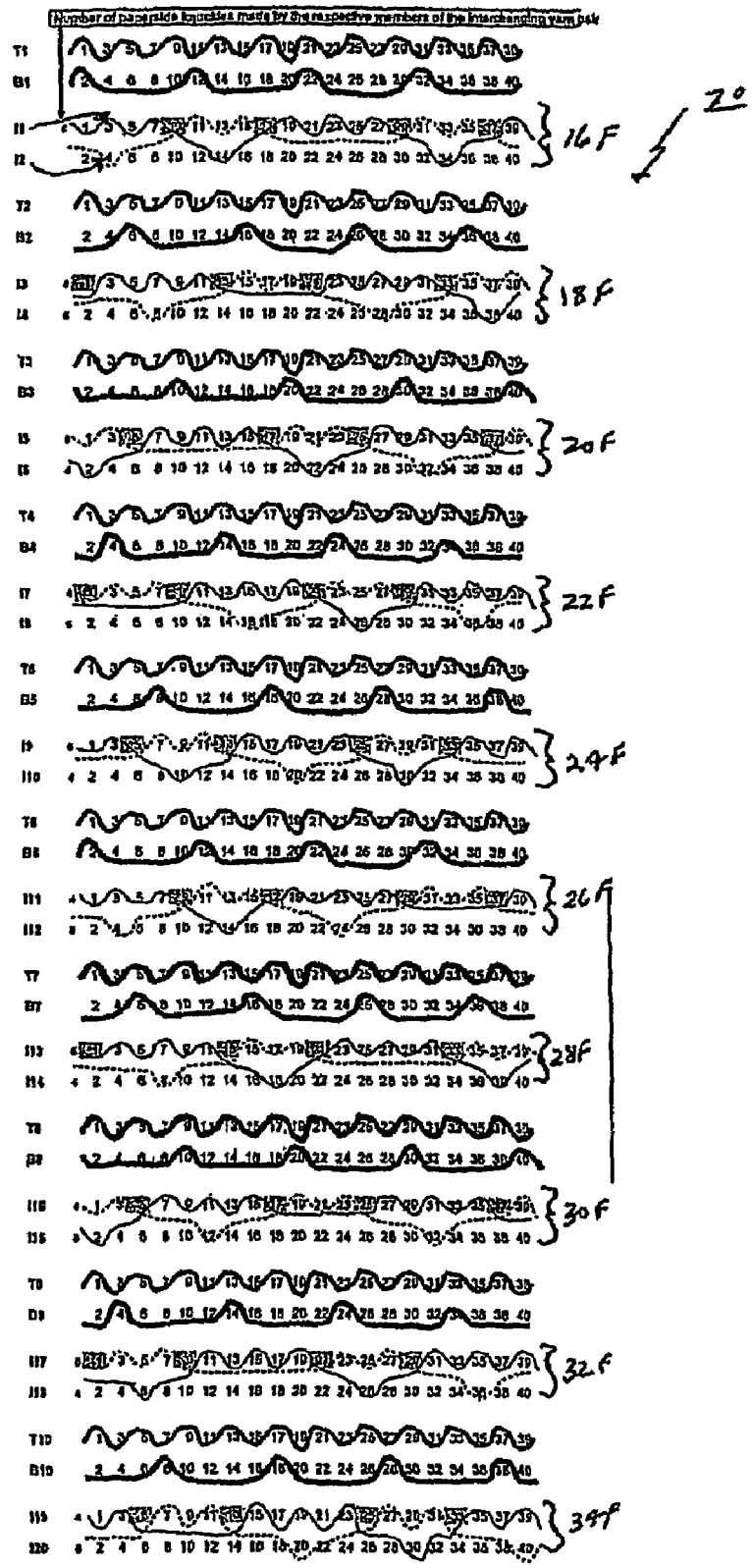
Fig 7-embodiment7 fig8-embodiment8

Fig D-embodiment D

FIG10-embodiment 10

FIG 11-embodiment 11

FABRICS WITH MULTI-SEGMENT, PAIRED, INTERCHANGING YARNS

FIELD OF THE INVENTION

The present invention relates to fabrics with multi-segment, paired, interchanging binder yarns, and more particularly to fabrics employed in web forming equipment, such as papermaking and non-woven web forming equipment. More particularly, the preferred fabrics of this invention are employed as forming fabrics in web forming equipment; most preferably in papermaking machines employed to make graphical paper having desired properties suitable for effectively receiving printing ink thereon.

BACKGROUND OF THE INVENTION

Papermaking involves the forming, pressing and drying of cellulosic fiber sheets. The forming process includes the step of depositing an aqueous stock solution of the fibers, and possibly other additives, onto the forming fabric upon which the initial paper web is formed. The forming fabric may run on a so-called Gap Former machine in which the aqueous stock initially is dewatered, and the initial paper sheet is formed between two forming fabrics.

An effective forming process typically produces a sheet with a very regular distribution of fibers and with a relatively high solids content, i.e., a high fiber-to-water weight ratio. In order to form a fibrous web with a desired uniform, regular distribution and high fiber-to-water weight ratio, the forming fabric must possess a number of properties. First, the papermaking surface should be relatively planar; resulting from the yarn floats in both the machine direction (MD) and cross-machine-direction (CD) lying at substantially the same height, to thereby prevent localized penetration of the fibers into the fabric. Such localized penetration results in "wire marks" which actually is the result of fiber basis weight variations throughout the sheet area. In addition, the MD and CD floats need to be distributed in a regular manner to avoid introducing undesired wire marks into the formed sheet. Moreover, these basis weight variations can result in undesired variations in sheet absorption properties; a property very relevant to the functionality of quality graphical papers where a consistent uptake of print ink is necessary to produce a clear sharp image.

Other factors also cause the formation of undesired wire marks. For example, wire marks can be introduced into the sheet by the flow of water around yarns positioned below the fabric's papermaking surface. This phenomena, referred to as "strike through," needs to be taken into account in designing the fabric construction.

Importantly, the forming fabric must also possess a high degree of dimensional stability. This high stability is necessary, for example, to minimize cyclic variations in fabric width, which can result in MD wrinkles in the fabric. This, in turn, contributes to the so-called, streaky sheet, i.e., a sheet with MD streaks created by variations in fiber basis weight.

Dimensional stability of a fabric typically is obtained by manufacturing the forming fabric with a relatively high mass of material. However, the use of thick yarns often causes undesirable wire marks. Consequently, there has been a trend to providing composite forming fabrics, that is, "multi-layer" structures, whereby a high number of relatively thin yarns are distributed throughout various fabrics layers to facilitate fabric stability.

One type of multi-layer structure is a triple-layer, or composite, fabric made by joining two (2) distinct fabrics, each with their own MD (warp) yarns and CD (weft) yarns, by the use of additional and independent "binding yarns." These binding yarns can be employed in either the MD or CD direction, and in this system provide the sole function of binding the two separate fabrics together. In other words, these binding yarns are not intended to function as part of the warp or weft yarn system in either the top fabric or the bottom fabric of the multi-layer structure. Such a triple-layer fabric is illustrated in EP 0,269,070(JWI Ltd.).

Where the two fabrics of the triple-layer structure are joined in either the MD or CD direction by binding yarns that also belong, or form part of the weave pattern of either, or both, of the paper side or wear side fabrics, the resulting structures are referred to more specifically as "self-stitched" triple-layer structures. Such binding yarns are referred to as intrinsic binding yarns. Self-stitched structures are taught in a number of prior art patents. For example, U.S. Pat. No. 4,501,303 (Nordiskafilt AB) discloses a triple-layer structure wherein paper side yarns are used to bind the paper side and wear side fabrics into one structure.

Triple-layer structures, whether employing separate and distinct binding yarns or intrinsic binding yarns that form part of the paper side and/or wear side weave structure, allow, to some extent, for the use of fine MD and CD yarns in the paper side fabric layer for improved papermaking quality and sheet release. Additionally, the use of significantly coarser yarns can be employed in the lower fabric layer, or wear side fabric layer, which contacts the paper machine elements, to thereby provide good stability and fabric life. Thus, these triple-layer structures have the capability of providing optimum papermaking properties in the paper side fabric layer and optimum mechanical properties in the wear side fabric layer.

In the known commercial embodiments of the triple-layer and self-stitched fabrics of the prior art the internal surface of the wear side fabric layer is dominated by floats of MD yarns. Where wear side fabric CD yarns interlace with wear side fabric MD yarns, such that the wear side CD yarns appear in the internal region between the paper side and wear side fabric layers, relatively prominent short weft knuckles are formed. The pressure of relatively stiff wear side MD yarns acting on the wear side CD yarns during the production of the fabric can cause so-called "knuckle spread," whereby the wear side CD yarn knuckles are distorted and their width increased to form a relatively large area. The location of such yarn mass areas within the fabric inner region reduces the ability of water to flow through the fabric in such yarn mass areas such that fabric dewatering may be adversely affected.

A further common feature of the known self-stitched and other triple-layer designs is that they are relatively thick structures with a high amount of empty space distributed throughout their thickness. The relatively high "void volume" is typically associated with sheet rewetting on the paper machine such that the sheet solids content at transfer to the press section may be undesirably low. That is, the fibrous web formed on the papermaking fabric has an undesirably low fiber-to-weight ratio. This can result in reduced papermaking machine performance through a higher amount of sheet breaks occasioned by the wetter sheet, reduced running speed and higher drying costs downstream of initial web formation.

The prior art '303 patent, referred to earlier herein, discloses embodiments which utilised more, and finer warp yarns in the paperside layer as compared to the warp yarns in the wear side layer. The wear side warp yarns in the '303 patent occur less frequently and are of a thicker diameter than the paper side warp yarns. Accordingly, the embodiments shown in '303 would have a relatively high thickness and corresponding void volume. These issues have been addressed somewhat by more recent patents, including U.S. Pat. No. 5,826,627 (Seabrook, et al.); U.S. Pat. No. 5,967,195 (Ward), and U.S. Pat. No. 6,145,550 (Ward). The entire subject matter of all these latter-identified patents is incorporated herein, by reference. All of these latter patents disclose self-stitched triple-layer fabrics with equal numbers of warp yarns in their paper side and wear side fabric layers. Consequently, there is still adequate MD orientated load bearing material, but a reduction in fabric thickness and void volume as compared to the embodiments shown in '303 patent is expected.

More recently, thickness and void volume of self-stitched fabrics have been the subject of EP 1,273,698, the subject matter of which is fully incorporated by reference herein. This latter publication describes the provision of self-stitched structures with reduced thickness and void volume compared to the prior art. To achieve such structures high numbers of thin paper side yarns are required to allow the fabric of the '698 publication to perform adequately. Thus processing costs are higher for such fabrics, as compared to fabrics requiring a lesser number of relatively thicker fabrics. Furthermore, the lifetime of such fabrics may be limited because a wear side CD yarn of relatively small diameter is typically chosen to facilitate the recessing of the thin, load bearing, wearside MD yarns into the fabric and away from the wearing elements of the paper machine. By comparison with the prior art fabrics, the embodiments of '698 publication are relatively thin and consequently are more prone to instability than such prior art fabrics. Consequently, sheet basis weight profiles may be adversely affected by the use of fabrics made in accordance with the teachings of the '698 patent.

Although the aforementioned composite papermaking fabrics employing intrinsic interchanging binder yarn pairs have provided improved structures, applicant believes that there still is a need for additional, improved composite structures of the type employing intrinsic interchanging binder yarn pairs providing a high resistance to delamination, or separation, of the paper side and machine side layers, and also providing a composite fabric of relatively low thickness and related low void volume, to improve paper sheet dryness, and with suitable fabric stability to produce sheets with good basis weight profiles, and further providing a composite fabric with high levels of wearable material on the fabric wear side layer to perform without mechanical problems for the desired duration of use. It is to such structures that the present invention is directed.

SUMMARY OF THE INVENTION

The above and other objects of this invention are obtained in "multi-segment" composite forming fabrics. Multi-segment composite forming fabrics (hereinafter sometimes referred to as "multi-segment fabrics") are herein defined as fabrics having at least one pair of interchanging weft pairs present in its paper side surface wherein the interchanging weft pair interchanges at least 4 times within each weave repeat as the fibers in the pair cooperate to provide a single continuous weft path in said repeat. By interchanging at least 4 times then at least 4 segments of the single continuous weft path are provided within each weave repeat. However, in the fabrics of this invention a segment is considered to have depth and not just a width, i.e., the segment depth extends to include the activities of the interchanging weft pair members between the paper side and wear side layers and also to include the activity of the interchanging weft pair members with the wear side MD yarns. Thus, where the segments are of similar, or of the same appearance on the fabric paper side surface, the segments may be differentiated from each other by their activities between the paper side and wear side layers and/or the interaction of the interchanging pair members with the wear side MD yarns. All segments may be of equal or unequal length in the fabric paper side layer or at least one segment may be of a different length from the other segments. The nature of the interaction of the interchanging weft pair with either or both of the paper side and wear side MD yarns may be the same for all segments or it may differ for all or at least some segments. The yarns of the interchanging weft pair may be both binder wefts, both top wefts, or only one of such interchanging yarns may be a binder or a top weft. When both of the interchanging weft yarns are top wefts they each interlace with paper side warp yarns to provide one or more paper side segments, and then, in regions underlying the other segments, float between the warp yarns in the top and wear side layers without binding to any wear side warp yarns. Thus, top weft/top weft interchanging yarn pairs do not cooperate to bind the paper side layer and the wear side layer together. When only one of the interchanging yarns in a pair is a top weft yarn the other interchanging yarn can be a binder yarn. In this latter weave structure the binder yarn of the pair binds to one or more wear side warp yarns in a region or regions underlying a paper side segment, or segments formed by the top weft yarn of the pair interlacing with paper side warp yarns to form the paper side segment, or segments, and the top weft yarn of the pair floats between the paper side and wear side warp yarns without binding to any wear side warp yarns in a region or regions underlying a paper side segment, or segments formed by the binder yarn of the pair interlacing with paper side warp yarns to form the paper side segment, or segments.

All multi-segment fabric will have a top paper side layer with a paper side surface, a machine side layer having a bottom wear side surface and a plurality of pairs of first and second intrinsic interchanging weft yarns; most preferably interchanging weft binder yarns. Reference throughout this application to "intrinsic interchanging weft binder yarns" or "interchanging weft binder yarns" means paired yarns, each of which forms a part of the weave structure in at least the paper side layer of the composite fabric and also binds the paper side layer and machine side layer together within each repeat of the weave pattern. Thus, each intrinsic weft binder yarn of each pair of first and second intrinsic weft binder yarns provides two functions within each repeat of the weave pattern. One function is to contribute to the weave structure of the paper side surface of the paper side layer, and the second function is to bind together the paper side layer and the machine side layer.

The fabrics in accordance with the preferred embodiments of this invention have a paper side layer and a machine side layer, with the machine side layer comprising MD (machine direction) warp yarns and non-interchanging CD (cross-machine-direction) weft yarns woven together, and the paper side layer either comprising MD warp yarns, interchanging weft pairs and non-interchanging CD weft yarns woven together or simply comprising MD warp yarns and interchanging weft pairs woven together. The paper side layer and machine side layer each have a weave pattern with a predetermined repeat in both the MD and CD directions. These fabrics include a plurality of pairs of first and second interchanging weft binder yarns; preferably all of said pairs having at least four (4) segments in the paper side layer within each repeat of the weave pattern. These segments provide an unbroken weft path in the paper side surface, with each succeeding segment being separated in the paper side surface of the paper side layer by at least one paper side layer transitional warp yarn.

The transitional warp yarn(s) define(s) the length of each segment made in the paper side layer of the fabric by each individual yarn of an interchanging yarn pair. Specifically, one yarn of each pair forms a segment of the paper side weft path and then drops out of the paper side surface adjacent one side of the transitional warp yarn, while the other yarn of the pair moves into the paper side layer adjacent the opposite side of the transitional warp yarn to begin forming a second segment of the paper side weft path.

When a pair of first and second intrinsic, interchanging weft binder yarns includes four segments in the paper side layer within each repeat of the weave pattern, each yarn of that pair interchanges positions into and out of the paper side layer four times within each such repeat. That is, a first yarn of the binder yarn pair is in the paper side layer in a first and third segment to form part of the continuous top weave pattern in each repeat; is in a machine side layer underlying a second and/or fourth segment of the paper side layer to bind to one or more bottom warp yarns in a region underlying such second and/or fourth segment, and then is in the paper side layer in a first segment of a new repeat of the weave pattern. The other, or second, yarn of the binder yarn pair is in the paper side layer in the second and fourth segments to cooperate with the first yarn of the pair to complete the continuous top weave pattern in each repeat of the weave pattern; is in a machine side layer underlying a first and/or third segment of the paper side layer to bind to one or more bottom warp yarns in a region underlying such first and/or third segment, and then is in the paper side layer in a second segment of a new repeat of the weave pattern.

In this way, when the yarns of the interchanging weft pair are both binder yarns, all segments may have underlying binder yarn interlacing with wearside MD yarns in their sub-surface region or, alternatively, there may only be some segments which have underlying sub-surface binder and wearside MD yarn interlacing.

In accordance with a first 20 shaft embodiment of this invention, wherein pairs of interchanging weft binder yarns are located between adjacent pairs of non-interchanging paper side weft yarns, said pairs of first and second intrinsic interchanging weft binder yarns include four segments. In a representative pair of binder yarns the second binder yarn binds to only a single bottom warp yarn in a region underlying only one of said second and fourth segments and floats between the top and bottom layers in a region underlying the other of said second and fourth segments to enhance CD stiffness of the fabric. In this embodiment the first binder yarn of the representative pair also binds to only one bottom warp yarn in a region underlying either the first or third segments, and then floats between the top and bottom layers of the fabric in the other of said first and third segments. Thus, the pairs of intrinsic, interchanging weft binder yarns bind to single bottom warp yarns in regions underlying only two segments within each repeat and each repeat includes two adjacent segments that are free of any underlying, bound, bottom warp yarns; the regions underlying these latter-two adjacent segments including binder yarn floats between the top and bottom layers to enhance the stiffness and stability of the fabric.

In accordance with a second 20 shaft embodiment, wherein pairs of interchanging weft binder yarns are again located between adjacent pairs of paper side weft yarns, the first yarn of a representative interchanging weft binder yarn pair is similar to the first binder yarn in the earlier described embodiment. That is, it binds to only a single bottom warp yarn in a region underlying only one of said first and third segments, and then floats between the top and bottom layers in a region underlying the other of said first and third segments to enhance CD stiffness of the fabric. However, in distinction to the above-described embodiment, in this embodiment the second yarn of the representative interchanging weft binder yarn pair binds to a single bottom warp yarn in regions underlying both said second and fourth segments and therefore does not float between the top and bottom fabric layers in any segments. From the above discussion it should be apparent that in this embodiment a bottom warp underlying three of the four segments is bound by one or the other of the first and second yarns in the pair of intrinsic, interchanging weft binder yarns.

In accordance with a third 20 shaft embodiment of this invention, a fabric is made as per the first embodiment described above, except that alternate interchanging weft binder yarn pairs are replaced by single paper side CD yarns The weave repeat size can be varied within the scope of the broadest aspects of this invention. In the four segment embodiments, the weave repeat may utilize the same number of shafts (i.e. number of warp yarns in the weave pattern before the weave pattern repeats) to that which has been used in the prior art (e.g., Seabrook U.S. Pat. No. 5,826,627, Ward U.S. Pat. No. 5,967,195 & U.S. Pat. No. 6,145,550, etc.) e.g. 20, or 24 shafts. Alternatively the weave repeat may be much higher. Illustrative but not limiting shaft numbers include 28, 32, 40, 48 and 100. Such fabrics may be produced using any of the techniques taught in co-pending provisional application titled "HIGH SHAFT FABRICS" filed on May 23, 2003, identifying Stewart Lister Hay and Arved H. Westerkamp as the inventors. The subject matter of this latter provisional application is fully incorporated herein by reference.

The prior art fabrics having 20 and 24 shaft repeats have several key common features viz each interchanging binder weft pair provides only two segments in the CD weave repeat and each segment features a sub-layer wherein one or other member of the binder pair interlaces with a wearside warp yarn.

By contrast, all of the embodiments of this invention have at least some interchanging weft pairs providing at least four segments within each weave repeat; preferably with at least one of the paper side segment sub-layers having no interlacing between either member of the binder pair and the machine side MD yarns. However, it is within the scope of this invention for the CD yarns in at least some interchanging binder pairs to provide binding in all segment sub-layers. It has been found that in 20 shaft fabrics of this invention, e.g., fabrics with relatively short segment lengths weaving with at least 4 segments within each weave repeat, a reduced thickness and void volume is provided as compared with the prior art fabrics having only two (2) segments. Consequently fabrics of this invention may have a beneficial tendency to reduce water carry on the paper machine such that a drier sheet of paper is produced on the fabric. A further advantage achieved in the 20 shaft fabric of this invention is that the burst strength of the fabric seam improved in comparison to the prior art 20 shaft structures having only two segments within each weave repeat. This is a very desirable feature, because seam failure in self-stitched triple-layer fabrics can be a cause of premature removal from the papermaking machine, thereby creating undesired machine downtime and undesired additional cost to replace and/or repair the fabric.

For higher shaft number embodiments of the invention average segment length can be increased such that transition point wire marking may be reduced. Furthermore, for such fabrics containing segment sub-layers wherein there is no interlacing between either member of the binder pair and the machine side MD yarns, then the binder pair member provides a binder stiffening section that enhances the fabric's CD bending stiffness such that during end-use the fabric will have minimal distortion and thereby help in minimizing undesired variations in sheet basis weight profiles.

In accordance with a first 28 shaft embodiment of this invention interchanging binder pairs are disposed between adjacent pairs of paper side weft yarns. The first member of a representative interchanging binder pair interlaces with paper side warp yarns to provide second and fourth paper side segments, and interlaces with one wear side warp yarn in sub-regions underlying the first and third paper side segments. By contrast, the second member of the representative interchanging binder pair interlaces with paper side warp yarns to provide first and third segments and interlaces with one wear side warp in each sub-region underlying the second and fourth segments. Consequently, all 4 segments of each binder pair have wear side warp and binder yarn interlacings in their sub-layer.

In accordance with a second 28 shaft embodiment of this invention interchanging binder pairs are disposed between adjacent pairs of paper side weft yarns. As with the previous 28 shaft embodiment a first member of a representative interchanging binder pair interlaces with paper side warp yarns to provide second and fourth segments and interlaces with one wearside warp in each sub-region of the first and third segments. The second member of the representative interchanging binder pair interlaces with paper side warp yarns to provide first and third segments, just as in the previously described 28 shaft embodiment. However, the second member of the representative binder pair in this embodiment interlaces with one wear side warp in the sub-region of only the fourth segment, while floating between paper side and wear side warps in the sublayer of the second segment such that a binder stiffening section is provided. Consequently, for all interchanging weft pairs in this embodiment, 3 of the 4 segments have wear side warp and binder yarn interlacings in their underlying sub-layer, and one of the four segments has a binder stiffening section located between the paper side and wear side layers.

In accordance with a 32 shaft embodiment of this invention, interchanging binder pairs are disposed between adjacent pairs of paper side weft yarns. A first member of a representative interchanging binder pair interlaces with paper side warp yarns to provide first and third segments and interlaces with one wear side warp yarn in sub-regions underlying the fourth segment while floating between paper side and wear side warp yarns in the sub-layer underlying the second segments, such that a binder stiffening section is provided. By contrast, the second member of the representative interchanging binder pair interlaces with paper side warp yarns to provide second and fourth segments and interlaces with one wear side warp in sub-regions underlying the first and third segments. Consequently, for all interchanging binder pairs in this embodiment, 3 of the 4 segments have underlying wear side warp and binder yarn interlacings in their sub-layer and one of the four segments has a binder stiffening section located between paper side and wear side layers.

In accordance with a first 40 shaft embodiment of this invention, interchanging binder pairs are disposed between adjacent pairs of paper side weft yarns. A first member of a representative interchanging binder pair interlaces with paper side warp yarns to provide first and third segments and interlaces with one wearside warp in sub-regions underlying the second and fourth paper side segments. By contrast, the second member of the representative interchanging binder pair interlaces with paper side warp yarns to provide second and fourth paper side segments and interlaces with one wearside warp in sub-regions underlying the first segments while floating between paper side and wear side warps in the sub-regions underlying the third segments, such that a binder stiffening section is provided. Consequently, 3 of the 4 paper side segments have underlying wear side warp and binder yarn interlacings in their sub-layer and one of the four segments has an underlying binder stiffening section located between paper side and wear side fabrics. The binder stiffening section provided by adjacent pairs of interchanging binder yarns alternates between 5 and 7 warp pairs.

In accordance with a second 40 shaft embodiment of this invention, interchanging binder pairs are disposed between adjacent pairs of paper side weft yarns. A first member of a representative interchanging binder pair interlaces with paper side warp yarns to provide second and fourth segments, interlaces with one wear side warp in the sub-regions underlying the first segments and floats between paper side and wear side warps in the sub-layer in regions underlying the third segments, such that a binder stiffening section of 5 warp yarns is provided. By contrast a second member of the representative interchanging binder pair interlaces with paper side warp yarns to provide first and third segments and interlaces with one wear side warp in sub-regions underlying the second and fourth segments. Consequently, 3 of the 4 paper side segments have underlying wear side warp and binder yarn interlacings in the sub-layer. The binder stiffening section provided by adjacent pairs of interchanging binder yarns is always equal to 5 warp pairs. Each binder of each pair provides two segments respectively of 4 and 6 paper side warp yarns in length.

In accordance with a third 40 shaft embodiment of this invention a fabric is provided which is identical to that in the previously described embodiment, with the exception that there are no binder stiffening sections i.e. all segment sublayers contain wear side warp and binder yarn interlacings.

It is also within the scope of this invention to provide fabrics with more than four paper side segments. Thus in accordance with other embodiments of the invention the fabrics employ a plurality of pairs of first and second intrinsic, interchanging weft binder yarns in six (6) top segments within each weave repeat. In these embodiments, a first intrinsic weft binder yarn of the pair is part of the continuous top weave pattern in first, third and fifth segments and the second intrinsic weft binder yarn of the pair is part of the continuous top weave pattern in the second, fourth and sixth segments to complete the continuous top weave pattern within each repeat.

In the six (6)-segment embodiments of this invention, the first intrinsic weft binder yarn may bind to one or more bottom warp yarns in regions underlying only one or two or all of said second, fourth and sixth segments and may float between the top and bottom layers in the segment sub-regions of any segments under which it doesn't bind. Likewise, the second intrinsic weft binder yarn may bind to one or more bottom warp yarns in regions underlying only one or two or all of said first, third and fifth segments and may float between the top and bottom layers in the segment sub-regions of any segments under which it doesn't bind.

In one six segment embodiment employing a 24 shaft repeat (i.e., 12 top warp yarns and 12 underlying bottom warp yarns) a single bottom warp yarn in the wear side fabric region underlying segments 3 and 6 is bound by each of the intrinsic interchanging weft binder yarns of the binder pairs within each repeat, respectively.

In another six segment embodiment employing a 48 shaft repeat (i.e., 24 top warp yarns and 24 underlying bottom warp yarns) a group of three adjacent bottom warp yarns interlace with the intrinsic interchanging weft binder yarns of the binder pairs within each repeat; respectively, said groups of adjacent bottom warp yarns underlying segments 1 and 4, respectively.

In the preferred embodiments employing six (6) segments, only two of which have underlying binder-warp interlacing in their sub-regions within each weave repeat, the adjacent bottom warp yarns (or groups of warp yarns) that interlace respectively, with the first intrinsic interchanging weft binder yarn and the second intrinsic interchanging weft binder yarn of each pair underlie non-adjacent segments. That is, there are no two adjacent segments having underlying, bound bottom warp yarns.

It also is within the scope of this invention to employ with the plurality of intrinsic interchanging weft binder yarn pairs including 4 or more segments within each weave repeat, some intrinsic interchanging weft yarn pairs having a different number of segments (e.g., 2) within each weave repeat. Moreover these different pairs of first and second intrinsic, interchanging weft yarns can be adjacent to each other, or separated by other intrinsic interchanging pairs of yarns, or other non-interchanging weft yarns in the paper side layer, as desired.

In accordance with another 40 shaft embodiment, interchanging binder pairs are disposed between adjacent pairs of paper side weft yarns. A first member of a first representative interchanging binder pair interlaces with paper side warp yarns to provide first and third segments and interlaces with one wear side warp in the sub-regions underlying the second and fourth segments. By contrast a second member of the first representative interchanging binder pair interlaces with paper side warp yarns to provide second and fourth segments and interlaces with one wear side warp in sub-regions underlying the first and third segments. Consequently, all of the 4 paper side segments of the first representative interchanging binder pair have underlying wear side warp and binder yarn interlacings in their sub-layer.

The first member of a second representative interchanging binder pair, by contrast, provides only one paper side segment within each weave repeat, as does a second member of the second representative interchanging binder pair. Each member of the second representative interchanging binder pair interlaces with two spaced apart warps of the wear side fabric to provide a binder stiffening section of 4 warp yarn duration. Thus the fabric of the twelfth embodiment has two distinct groups of interchanging binder pairs within its structure and by this means reduces the transitional points relative to other 40 shaft fabrics of the invention while providing stiffening sections to improve sheet profile control.

Although all embodiments illustrated have a paper side to wear side MD yarn ratio of 1:1 this is merely illustrative and not restrictive as the fabrics of the invention can also have ratios of 2:1, 3:2, etc. The effective ratio of paper side CD paths to wear side CD yarns may similarly be chosen from the group including 1:1; 2:1; 3:1; 3:2; 4:3 etc. The chosen ratio of the paper side CD paths to the wear side CD yarns will modify fabric properties, e.g., a fabric with 2:1 CD ratio will have 2 paper side wefts or weft paths for every one wear side CD yarn but a fabric with 1:1 CD ratio, and the same total number of CD yarns as the aforementioned 2:1 CD ratio fabric, will have the same number of paper side wefts or weft paths as wear side CD yarns. Consequently the latter fabric would be expected to provide more wear side yarns for wear but less paper side CD yarns for sheet support and papermaking properties when compared to the former fabric. Consequently the choice of CD ratio for an end-use application may be driven by the relative importance of sheet quality or long fabric life. Note that in describing the paper side CD support the term weft paths has been used. This terminology reflects the use of pairs of interchanging weft yarns to provide a single weft path in the paper side as opposed to the use of the term weft yarns in describing the wear side, wherein no pairs of interchanging yarns provide single weft paths but instead all weft paths are provided by individual, non-interchanging, wear side weft yarns.

Applicants are not aware of any prior art composite fabric structures employing a plurality of pairs of intrinsic, interchanging weft yarns wherein the interchanging weft yarns include at least four segments within each repeat of the weave pattern.

BRIEF DESCRIPTION OF THE DRAWINGS

FIG. 1 shows the weave paths for all paper side wefts, wear side wefts, and interchanging binder yarn pairs of a first 20 shaft fabric in accordance with this invention;

FIG. 2 shows the weave paths for a number of paper side wefts, wear side wefts, and interchanging binder yarn pairs of a second 20 shaft fabric in accordance with this invention;

FIG. 3 shows the weave paths for a number of paper side wefts, wear side wefts, and interchanging binder yarn pairs of a third 20 shaft fabric in accordance with this invention;

FIG. 4 shows the weave paths for all paper side wefts, wear side wefts, and interchanging binder yarn pairs of a first 28 shaft fabric in accordance with this invention;

FIG. 5 shows the weave paths for all paper side wefts, wear side wefts, and interchanging binder yarn pairs of a second 28 shaft fabric in accordance with this invention;

FIG. 6 shows the weave paths for all paper side wefts, wear side wefts, and interchanging binder yarn pairs of a first 32 shaft fabric in accordance with this invention;

DESCRIPTION OF THE PREFERRED EMBODIMENTS OF THE INVENTION

Figure 7:
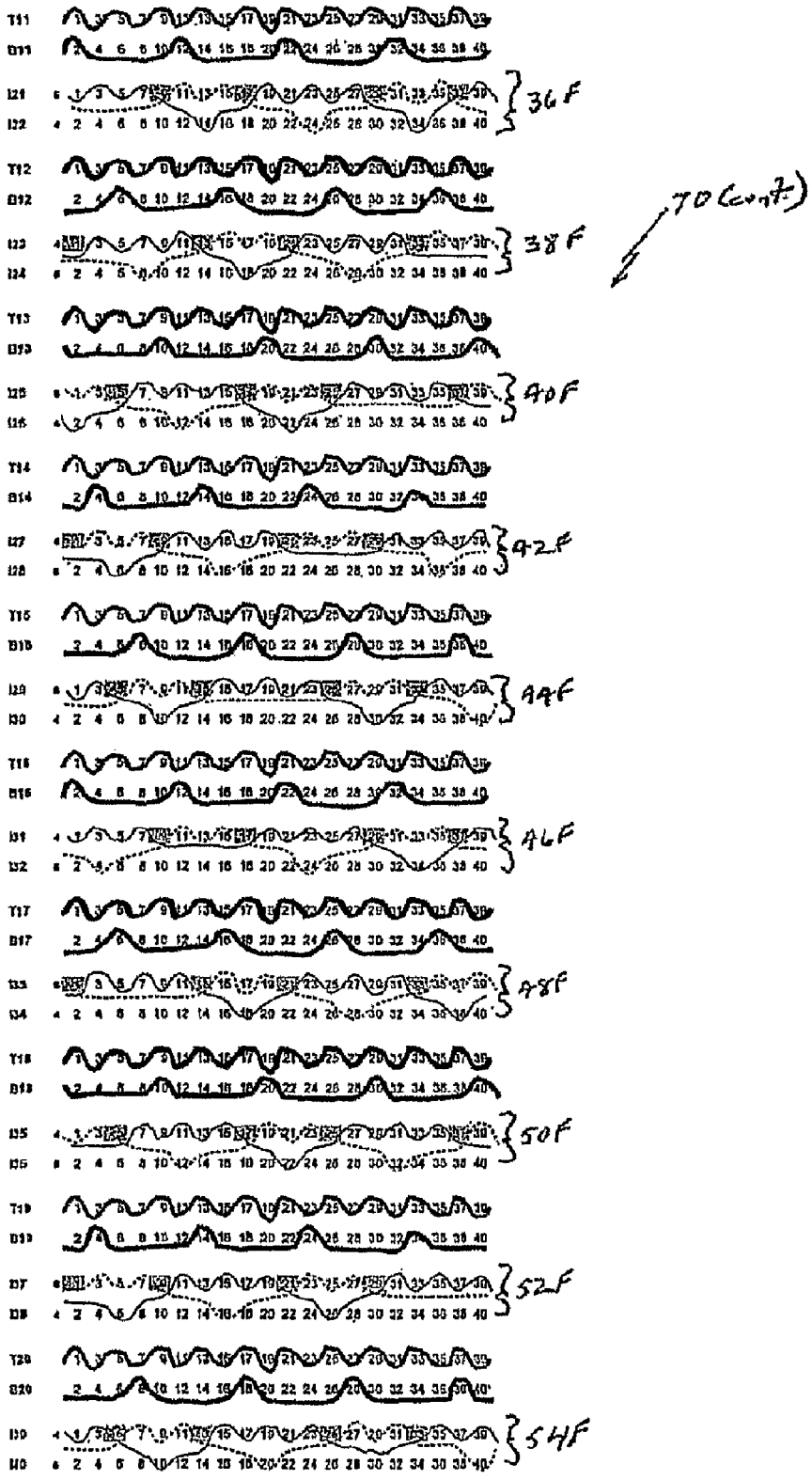
FIG. 7 shows the weave paths for all paper side wefts, wear side wefts, and interchanging binder yarn pairs of a first 40 shaft fabric in accordance with this invention.

Referring to FIG. 1, the weave paths of all paper side weft, wear side weft and interchanging binder yarn pairs are fully illustrated for a fabric 10 in accordance with this invention. The fabric 10 has a twenty 20 shaft repeat, including a top layer 12 having a paper side surface, a machine side layer 14 having a bottom wear side surface and a plurality of pairs of first and second intrinsic interchanging weft binder yarns 16, 18, 20, . . . 34. As illustrated in the weave paths of the yarns depicted in FIG. 1, the top layer 12 includes top warp yarns 1, 3, 5, . . . 19 within each repeat, interwoven with top weft yarns T1, T2, T3 . . . T10 and top segments of the interlacing binder pairs 16, 18, 20 . . . 34 to form a plain weave. However, it is within the scope of the broadest aspects of this invention to employ other weave patterns such as, for example, 3, 4, 5, 6, 7, 8 shaft regular or irregular twill weave or 4, 5, 6, 7, or 8 shaft regular or irregular sateen.

The machine side layer 14 includes bottom warp yarns 2, 4, 6, . . . 20 within each repeat, interwoven with non-interchanging bottom weft yarns B1, B2 . . . B10. The illustrated bottom weave pattern is a 5 shed repeat; with a two step relationship between adjacent bottom weft yarns; however, other bottom weave patterns can be employed in accordance with the broadest aspects of this invention. To further explain, bottom weft yarn B1 binds over bottom warp yarns 2 and 12 while passing under 4 consecutive warp yarns between bottom warp yarns 2 and 12 and between bottom warp yarns 12 and 2. B2 then steps 2 warp yarns to the right to bind with bottom warp yarns 6 and 16 while passing under 4 consecutive warp yarns between bottom warp yarns 6 and 16 and between bottom warp yarns 16 and 6. This same 2 step relationship repeats for the entire weave repeat.

As is shown in FIG. 1, each pair 16, 18, etc. of intrinsic, interchanging weft binder yarns includes four segments in the paper side layer within each repeat of the weave pattern in the composite fabric. The four segments of the intrinsic interchanging weft binder yarns in the top layer 12, which are designated "Seg 1," "Seg 2," Seg 3" and "Seg 4" in binder pairs 16 and 18, provide an unbroken weft path in the paper side surface, with each succeeding segment being separated in the paper side surface of the top layer by a top layer transitional warp yarn, i.e., top warp yarns 1, 5, 13, and 17 in the binder pair 16 and top warp yarns 1, 5, 9 and 13 in the binder pair 18 are transitional warp yarns. That is, one of the interchanging weft binder yarns in each pair moves downwardly, out of the top layer by passing along one side of the transitional warp yarn, and the other yarn of the interchanging yarn pair moves into the top layer by passing along the opposite side of the transitional warp yarn. In this arrangement, the crossover points between the interchanging yarns, which are the transition points of such interchanging yarns, are generally located below the paper side layer in a region generally vertically underlying the transitional warp yarns. Moreover the number of transition points or transitional warp yarns within each repeat of the weave pattern is equal to the number of segments within the repeat. Although the transitional region is generally beneath the transitional warp yarn reference may be made to the area above the transitional warp yarn as the transitional region, for example, in describing the paper side surface. The term "interchange point" may be used interchangeably with transition point.

In this preferred embodiment, the pairs of intrinsic, interchanging weft binder yarns account for 50% of the cross-machine-direction weft pattern in the paper side layer; being located between each pair of top weft yarns, e.g., T1, T2. That is, every other weft yarn path in the paper side layer 12 is provided by an intrinsic, interchanging weft binder yarn pair. However, it is within the scope of this invention to include either a greater percentage or a lesser percentage of intrinsic interchanging weft binder yarn pairs in the cross-machine direction of the composite fabric. For example, but not by way of limitation, all weft paths or every fifth, fourth or third weft yarn path in the paper side layer may be provided by an intrinsic interchanging weft binder yarn pair; thereby resulting in a composite fabric wherein 100%, 20%, 25% or 33%, respectively, of the weft yarn paths in the paper side layer are provided by interchanging weft binder yarn pairs.

In a preferred embodiment of this invention, each of the pairs of first and second intrinsic interchanging yarns within each repeat of the weave pattern are intrinsic weft binding yarn pairs for binding together the paper side layer and the machine side layer, e.g., binding yarn pairs 16 and 18. In other words, each of the yarns in the interchanging yarn pairs bind with the machine side layer in a region underlying at least one of the four segments within each repeat of the weave pattern. In accordance with this aspect of the invention, each of the interchanging binder yarn pairs in the structure can provide the same weave pattern, or same general type of weave pattern, as illustrated in FIG. 1, although this is not required in accordance with the broadest aspects of the invention.

As illustrated in FIG. 1, a first yarn I1 (binder indicated by dotted line) of the interchanging weft binder yarn pair 16 forms a portion of the weave pattern on the paper side layer 12 in the second and fourth segments within each repeat; floats between the top and bottom warp yarns (i.e., between the top and bottom layers 12, 14) in a region underlying the third segment of the paper side layer weave pattern and also binds with a single bottom warp yarn 4 in the machine side layer 14 in a region underlying the first segment of the paper side layer weave pattern. However, if desired the first interchanging yarn I1 can float between the paper side layer 12 and the machine side layer 14 in either the region underlying the first segment or the third segment of the paper side layer weave pattern; but must bind to the machine side layer in at least one of said first and third segments.

In a similar manner, the second yarn I2 (binder indicated by solid line) of the pair of intrinsic interchanging weft binder yarns 16 binds with warp yarn 10 in the machine side layer 14 in a region underlying the second segment of the weave pattern in the paper side layer 12, floats between the paper side layer 12 and the machine side layer 14 in the region underlying the fourth segment and forms the cross-direction weft path in the paper side layer in the first and third segments; thereby cooperating with the first binder yarn I1 to form a continuous weave pattern in the top paper side layer 12 within the 20 shaft weave repeat. As is the case with the first yarn I1 of the interchanging yarn pair 16, the second yarn I2 of that pair can float between the paper side layer 12 and the machine side layer 14 in the region underlying either the second segment or the fourth segment of the paper side layer repeat pattern; but must bind to the machine side layer in at least one of said second and fourth segments.

Still referring to FIG. 1, a first yarn I3 (solid line) of the interchanging weft binder yarn pair 18 forms a portion of the weave pattern of the paper side layer 12 in the first and third segments within each repeat; floats between the top and bottom warp yarns (i.e., between the top and bottom layers 12, 14) in a region underlying the second segment of the paper side layer weave pattern and also binds with a single bottom warp yarn 18 in the machine side layer 14 in a region underlying the fourth segment of the paper side layer weave pattern. However, if desired the first interchanging yarn I3 can float between the paper side layer 12 and the machine side layer 14 in either the region underlying the second segment or the fourth segment of the paper side layer repeating weave pattern; but must bind to the machine side layer in at least one of said second and fourth segments.

In a similar manner, the second intrinsic interchanging weft binder yarn I4 (dotted line) of the pair of intrinsic interchanging weft binder yarns 18 binds with the machine side layer 14 (i.e., with bottom warp yarn 4) in the region underlying the first segment of the weave pattern in the paper side layer 12 and forms the cross-direction weft in the paper side layer 12 in the second and fourth segments; thereby cooperating with the first binder yarn I3 to form a continuous weave pattern in the top layer 12 within the 20 shaft woven repeat. The second intrinsic binder yarn I4 of the intrinsic binder pair

18 can float between the paper side layer 12 and the machine side layer 14 in the region of either the first segment or third segment of the paper side layer repeat pattern; but must bind to the machine side layer in at least one of said first and third segments. As illustrated the binder yarn I4 floats between the paper side layer 12 and the machine side layer 14 in the region underlying the third section.

Thus, in accordance with this aspect of the invention, each interchanging weft binder yarn I1, I2 of binder pair 16 and each interchanging weft binder yarn I3, I4 of binder pair 18 binds with the machine side layer in a region underlying at least one of the four segments in each repeat of the paper side layer weave pattern. Moreover, in the above-described, four segment construction the two yarns of each of the weft binder yarn pairs 16, 18 cooperate to bind to the machine side layer in regions underlying at least two adjacent paper side segments. In the illustrated embodiment, the binder yarns of the pairs 16, 18 do actually bind with the machine side layer in regions underlying two adjacent paper side segments such that there are also two regions in the machine side layer underlying adjacent paper side segments where there is no binding between binder yarns and wear side warp yarns. The above-described weave relationship exists for all of the other interchanging pairs 20, etc. in accordance with the embodiment of the invention illustrated in FIG. 1. However, as will be explained in detail in connection with the construction illustrated in other figures, the composite fabric can include only one or zero segments within each repeat wherein there is no binding of either of the two weft binder yarns of the interchanging yarn pairs 16 or 18 with the machine side layer 14.

In the fabric 10, each of the intrinsic weft binding yarns of each of the interchanging yarn pairs 16, 18, . . . 34 floats between at least two (2) adjacent pairs of top and bottom warp yarns in the paper side layer 12 and the machine side layer 14 in regions underlying adjacent paper side segments within each repeat of the weave pattern to provide binder stiffening sections. However, it should be noted that a stiffening section can be provided by an interchanging top weft yarn (i.e., an interchanging yarn that does not bind to the wear side fabric). In this latter case the stiffening section is a top weft stiffening section, as opposed to a binder stiffening section. In either event, the stiffening sections may enhance the cross-machine-direction stiffness of the fabric. In the interchanging binder pair 16, intrinsic weft binding yarn I1 floats between three (3) adjacent pairs of top and bottom warp yarns 13&14, 15&16 and 17&18 under the third segment and intrinsic weft binder yarn I2 floats between three (3) adjacent pairs of top and bottom warp yarns 17&18, 19&20 and 1&2 under the fourth segment.

In the interchanging binder pair 18, the intrinsic weft binding yarn I3 floats between three (3) adjacent pairs of top and bottom warp yarns 5&6, 7&8 and 9&10 under the second segment and intrinsic weft binder yarn I4 floats between three (3) adjacent pairs of top and bottom warp yarns 9&10, 11&12 and 13&14 under the third segment. This same relationship exists for all of the other interchanging binder pairs, as can be seen readily in FIG. 1. This construction provides very effective binding of the two fabric layers together, while, at the same time, providing an enhanced cross-machine-direction stiffness resulting from the binder stiffening sections provided by each of the yarns of each of the interchanging yarn pairs 16, 18, etc. floating between the paper side layer and the machine side layer in a single, but different segment of the repeat of the weave pattern, respectively.

Reference to a "binder stiffening section" refers to a section wherein a binder yarn of the pair binds to spaced-apart warp yarns in a single layer, wherein the spaced-apart warp yarns are separated by at least two (2) adjacent pairs of top and bottom warp yarns between which the binder yarn passes. If a top weft yarn of the interchanging binder pair weaves in the aforesaid manner, than the stiffening section is referred to as a "top weft stiffening section." Reference to a "stiffening section" generically refers to a section wherein a yarn of an interchanging yarn pair, whether a binder yarn or top weft yarn, binds to spaced-apart warp yarns in a single layer, wherein the spaced-apart warp yarns are separated by at least two (2) adjacent pairs of top and bottom warp yarns.

Still referring to FIG. 1 each interchanging binder yarn pair 16, 18, etc. has one binder yarn which provides a longer segment than the segments formed by the other yarn of the binder pair. Consequently it is possible to reverse the insertion order of alternate binder pairs such that the position of the longer segment is disturbed, or varied. This is indeed the case for the fabric shown in FIG. 1 wherein pair 16 has yarn I1 inserted first and provides segment 2 at a length of 4 warp yarns (transitional warp 5 and warps 7,9 & 11) and segment 4 at a length of 2 warp yarns (transitional warp 17 and warp 19) while yarn 12 was inserted second and provides 2 segments (segment 3 and segment 1) both at a length of 2 warp yarns (transitional 13 and warp 15 for segment 3 and transitional 1 and warp 3 for segment 1) such that the yarn with the long paper side segment was inserted first. This insertion order was reversed for pair I3/4 wherein the second inserted yarn of the pair (I4) provided the only long segment viz segment 4.

Reversing insertion order can be carried out when there are segments of different length or where yarns in an interchanging pair are of different material and/or diameter or where segments are of equal length and interlacings with warps are of equal frequency in order to space apart these interlacings in the fabric and thereby disturb any twill lines which may be formed by the regular spacing of paper side knuckles formed by the interchanging yarns.

Fabric having the weave pattern shown in FIG. 1 was made and tested for various parameters and the results compared with fabric woven according to the prior art structure disclosed in FIG. 1 of the Ward '195 patent. Both fabrics were woven with the same number of MD and CD yarns. The yarn types and diameters were also kept constant for both fabrics. Fabric details and test results are shown in Table 1 for the respective fabrics.

TABLE 1

| | Paper side MD/CD Diameter (mm) | Wear side MD/CD Diameter (mm) | Paper side MD/CD Yarns/cm | Wear side MD/CD Yarns/cm | Thickness (mm) | Permeability (cfm) | Void Volume (cc/m2) |
|---|---|---|---|---|---|---|---|
| Prior Art | 0.14/0.13 | 0.18/0.25 | 32.9/39.0 | 32.9/19.5 | 0.831 | 367 | 502 |
| Invention | 0.14/0.13 | 0.18/0.25 | 32.8/38.6 | 32.8/19.3 | 0.808 | 330 | 480 |

It can be seen in Table 1 that the invention provides a thinner fabric with a reduced openness as indicated by air permeability in cubic feet per minute (cfm) measured at 0.5 inch of water pressure differential. Similarly the void volume values in cubic cm per square metre of cloth show that the invention provides a structure with a reduced capacity to hold water and thus the invention offers a means to reduce sheet rewetting on the paper machine.

Referring now to FIG. 2, the weave paths for a number of paperside wefts, wearside wefts and pairs of intrinsic interchanging weft binder yarns are illustrated for a second embodiment of a fabric 20 in accordance with this invention. The fabric 20 is a 20 shaft fabric and is the same as the fabric 10, with one exception. In the fabric 20 one of the intrinsic interchanging weft binder yarns in each pair of intrinsic interchanging weft binder yarns binds with an additional wearside warp yarn such that regions under three segments are bound by a binder yarn. In intrinsic interchanging weft binder yarn pair 16A binder I1 binds with one single machine side warp yarn (4) within each repeat, and the binder I2 binds with two single machine side warp yarns (10 and 20, respectively) within each repeat. The machine side warp yarns 4, 10, 20 bound by interchanging weft binder yarns I1, I2 are adjacent each other, i.e., underlying segment 1 and adjacent segments 2 and 4 in the weave repeat, respectively.

Referring to FIG. 3, the weave paths for a number of weft yarns in a third embodiment of a fabric in accordance with this invention is illustrated, and the fabric employing this weave construction is identified as 30. The fabric 30 is identical to the fabric 10, with one exception. The fabric 30 includes intrinsic interchanging weft binder pairs 16B, 18B, etc. The fabric 30, like the fabric 10, has a 2:1 effective ratio of paperside to wearside weft paths. However, in comparison to the fabric 10, the fabric 30 has pairs of intrinsic binder yarns replaced by single paper side weft yarns such that the binder pairs no longer alternate with all of the top weft yarns T1, T2, etc. As illustrated single paper side weft yarn T3 replaces an interchanging binder yarn pair of the type employed in the fabric 10. This provides a means to further adjust the properties of the fabrics in accordance with this invention. This technique may be utilized for all embodiments of the invention such that there may be one, two, three, or irregular numbers of paper side wefts positioned between adjacent pairs of interchanging yarns. This of course only applies to such embodiments of the invention which incorporate separate paper side weft yarns therein.

Referring to FIG. 4, a fourth embodiment of this invention is a 28 shaft repeat fabric 40, which is fully illustrated. A representative intrinsic interchanging weft binder pair employed in this fourth embodiment is illustrated by the designation 16C. As shown in FIG. 4, all of the intrinsic interchanging weft binder pairs employed in this embodiment can be of the same weave structure as pair 16 C. FIG. 4 does show the full repeat of all interchanging binder yarn pairs within each weave repeat, as will be discussed in greater detail hereinafter.

In the FIG. 4 embodiment, the 14 paper side wefts T1,T2, T3 . . . T14 interlace with the 14 paper side warps 1,3,5 . . . 27 in an "over one-under one sequence" such that each weft yarn makes 7 repeats of plain weave within each 14 warp yarn repeat of the overall weave pattern. The 14 wear side wefts B1, B2 . . . B14 within each repeat interlace with the 14 wear side warps 2,4,6 . . . 28 within each repeat in a seven shaft repeat, i.e., an "over one-under 6 sequence" to make 2 repeats of 7 shaft within each 14 shaft repeat of the weave pattern. The 14 interchanging binder yarn pairs 16C, 18C . . . 42C within each full weave repeat interlace with the 14 paper side and 14 wear side warps, such that the full fabric weave repeat requires 28 warp yarns.

Binder I1 in pair 16C is represented by the solid line and weaves as follows: it binds with wear side warp 4 under segment 1, provides segment 2 consisting of transitional warp 5 and interlacings with warps 7,9,11, binds with wear side warp 18 under segment 3 and provides segment 4 consisting of transitional warp 21 and interlacings with warps 23, 25 and 27. Thus binder 11 provides 2 paper side segments, each of a 4 warp yarn duration, and also provides bindings under the remaining two segments.

Binder I2 in pair 16C is represented by the dotted line and weaves as follows: it provides segment 1 consisting of transitional warp 1 and interlacings with paper side warp 3, it binds with wear side warp 10 under segment 2, provides segment 3 consisting of transitional warp 13 and interlacings with paper side warps 15, 17, 19 and binds with wear side warp 26 under segment 4. Thus binder I2 provides 1 paper side segment of 2 warps duration and 1 paper side segment of 4 warps duration and also provides bindings under the remaining two segments.

As noted above, interchanging binder yarns I1 and I2 in pair 16C cooperate to provide 4 segments, each of which is bound by the interlacing of a binder with an underlying single wear side warp yarn.

Interchanging binder yarns I1 and I2 in pair 16C are illustrative of the other interchanging binder pairs and so these are not described further other than to note that the insertion order is reversed from pair to pair such that the binder providing the two long segments is alternately inserted first and second in adjacent interchanging binder yarn pairs, such that the full weave repeat requires 14 paper side weft yarns, 14 wear side weft yarns and 14 pairs of interchanging binder yarn pairs.

Referring to FIG. 5, a fifth embodiment of this invention is fully illustrated at 50, which is a fabric having a 28 shaft repeat. An intrinsic interchanging weft binder pair employed in the fabric 50 in accordance with this invention is illustrated at 16D. All of the intrinsic interchanging weft binder yarn pairs employed in this embodiment can be of the same structure as pair 16D, and actually are all illustrated in FIG. 5.

In the fabric 50 illustrated in FIG. 5, the 14 paper side wefts T1,T2,T3 . . . T14 interlace with the 14 paper side warps 1,3, 5 . . . 27 within each weave repeat in an "over one-under one sequence," such that each weft makes 7 repeats of plain weave within the 14 paper side warp weave repeat. The 14 wear side wefts B1, B2 . . . B14 interlace with the 14 wear side warps 2,4,6 . . . 28 within each weave repeat in seven shaft repeat in which each wear side weft follows an "over one-under 6 sequence" to make 2 repeats of 7 shaft within each full weave repeat. The 14 interchanging binder pairs 16D, 18D . . . 42D interlace with the 14 paper side and 14 wear side warps such that the full fabric weave repeat requires 28 warp yarns.

Binder I1 in pair 16D of fabric 50 is represented by the solid line and weaves as follows: it binds with wear side warp 4 under segment 1, provides segment 2 consisting of transitional warp 5 and interlacings with warps 7, 9, 11, binds with wear side warp 18 under segment 3 and provides segment 4 consisting of transitional warp 21 and interlacings with warps 23, 25, 27. Thus, binder I1 provides 2 paper side segments of 4 warps duration and also provides bindings under the remaining two segments. Binder I1 in the fabric 50 is identical to binder I1 in the fabric 40.

Binder I2 in pair 16D of fabric 50 is represented by the dotted line and weaves as follows: it provides segment 1 consisting of transitional warp 1 and interlacings with paper side warp 3, it provides a binder stiffening section under segment 2 and part of segment 3 by floating between contiguous paper side and wear side warp pairs 5&6, 7&8, 9&10, 11&12, 13&14 in between binding to top warp yarns 3 and 15, provides segment 3 consisting of transitional warp yarn 13 and interlacings with paper side warps 15,17,19 and binds with wear side warp 26 under segment 4. Thus, I2 in pair 16D provides 1 paper side segment of 2 warps duration, 1 paper side segment of 4 warps duration, a binding under another segment and a binder stiffening section under yet another segment.

Thus, it should be apparent that interchanging binder yarns I1 and I2 in pair 16D cooperate to provide 4 paper side segments; 3 of which are bound by the interlacing of a binder with an underlying single wear side warp yarn. The remaining segment is "stiffened" to thereby increase the fabric cross-machine direction (CD) bending stiffness and thereby optimize sheet basis weight profiles.

Interchanging binder yarns I1 and I2 in pair 16D are illustrative of the weave pattern of the other interchanging binder yarn pairs in the fabric 50. Therefore, the remaining interchanging yarn pairs are not described further other than to say that the insertion order of the yarns in adjacent pairs is reversed from pair to pair such that the binder providing the two long segments is alternately inserted first and second, such that the full weave repeat requires 14 paper side weft yarns, 14 wear side weft yarns and 14 pairs of interchanging binder pairs.

Referring to FIG. 6, a sixth embodiment of this invention is a 32 shaft fabric and is fully illustrated at 60. A representative intrinsic interchanging weft binder pair employed in fabric 60 in accordance with this invention is illustrated at 16E. All of the intrinsic interchanging weft binder pairs employed in this embodiment can be of the same structure as pair 16E, as is illustrated in FIG. 6.

In FIG. 6, 16 paper side wefts T1,T2,T3 . . . T16 within the full weave repeat interlace with the 16 paper side warps 1,3, 5 . . . 31 within the full weave repeat in an "over one-under one sequence," such that each paper side weft makes 8 repeats of plain weave, the 16 wear side wefts B1,B2 . . . B16 within each full repeat interlace with the 16 wear side warps 2,4, 6 . . . 32 within each full repeat to provide an 8 shaft repeat wherein each wear side weft weaves in "over one-under 7 sequence" to make 2 repeats of 8 shaft within the 16 wear side warp weave repeat. The 16 interchanging binder pairs 16E, 18E . . . 46E within each repeat interlace with the 16 paper side and 16 wear side warps such that the full fabric weave repeat requires 32 warp yarns.

Binder I1 in pair 16E is represented by the solid line and weaves as follows: it provides segment 1 consisting of transitional warp 1 and interlacings with warps 3,5,7, it provides a binder stiffening section under segment 2 and part of segment 3 by floating between the contiguous paper side and wear side warp pairs 9&10, 11&12, 13&14, 15&16, 17&18 between binding to top warp yarns 7 and 19, it provides segment 3 consisting of transitional warp 17 and interlacings with warps 19,21,23 and it binds with wear side warp 30 under segment 4. Thus, I1 provides 2 paper side segments of 4 warps duration, a binding under another segment and a binder stiffening section under yet another segment.

Binder I2 in pair 16E is represented in dotted line and weaves as follows: it binds with wear side warp 6 under segment 1, it provides segment 2 consisting of transitional warp 9 and interlacings with paper side warps 11, 13, 15, it binds with wear side warp 22 under segment 3, and it provides segment 4 consisting of transitional warp 25 and interlacings with paper side warps 27, 29 and 31. Thus, binder yarn I2 provides 2 paper side segments of 4 warps duration, and underlies the other two sections to bind to a single bottom warp yarn in each of such other two sections.

Thus, interchanging binder yarns I1 and I2 in pair 16E cooperate to provide 4 segments, 3 of which are bound by the interlacing of an underlying binder yarn with a single wear side warp yarn. The remaining segment is "stiffened" to thereby increase the fabric cross-machine-direction (CD) bending stiffness and so optimize sheet basis weight profiles.

Interchanging binder yarns I1 and I2 in pair 16E are illustrative of the other interchanging binder yarn pairs and so these latter binder yarn pairs will not be described in detail herein. Suffice it to state that, although all segments are of equal length (i.e., 4 warp yarns in length), the insertion order is reversed from pair to pair such that the binder providing the stiffening section is alternately inserted first and second, respectively, such that the full weave repeat requires 16 paper side weft, 16 wear side weft and 16 pairs of interchanging binder pairs.

Referring to FIG. 7, a seventh embodiment of a fabric of this invention is a 40 shaft repeat and is fully illustrated at 70. A first intrinsic interchanging weft binder pair employed in fabric 70 is illustrated at 16F. A second intrinsic interchanging weft binder pair employed in fabric 70 is illustrated at 18F. All of the intrinsic interchanging weft binder pairs employed in this embodiment can be of the same structure as either pair 16F or pair 18F, as is shown in FIG. 7. The weave structure of interchanging binder yarn pairs 16F and 18F will be explained in detail hereinafter, it being understood that the weave pattern in the remaining interchanging binder pairs will be readily appreciated by a person skilled in the art based on the presentation in FIG. 7.

In FIG. 7, the 20 paper side wefts T1,T2,T3 . . . T20 within the complete weave repeat interlace with the 20 paper side warps 1,3,5 . . . 39 within the complete weave repeat in an "over one-under one sequence" such that each weft makes 10 repeats of plain weave within the 40 shaft repeat of the fabric. The 20 wear side wefts B1,B2 . . . B20 within the complete weave repeat interlace with the 20 wear side warps 2,4,6 . . . 40 within the complete weave repeat in a 5 shaft repeat, i.e., an "over one-under 4 sequence" to make 4 repeats within the weave repeat. The 20 interchanging binder pairs 16F, 18F . . . 54F interlace with the 20 paper side and 20 wear side warps such that the full fabric weave repeat requires 40 warp yarns.

Binder I1 in pair 16F is represented by the solid line and weaves as follows: it provides segment 1 consisting of transitional warp 37 and interlacings with warps 39, 1, 3, 5, 7, it binds with wear side warp 14 under segment 2, it provides segment 3 consisting of transitional warp 17 and interlacings with warps 19, 21, 23, 25, 27 and it binds with wear side warp 34 under segment 4. Thus binder yarn I1 provides 2 paper side segments, each of 6 warp yarn duration, and binds to a bottom warp yarn under another two segments.

Binder I2 in pair 16F is represented by the dotted line and weaves as follows: it binds with wear side warp 4 under segment 1, it provides segment 2 consisting of transitional warp 9 and interlacings with paper side warp 11,13,15, it provides a binder stiffening section under segment 3 and part of segment 4 by floating between contiguous paper side and wear side warp pairs 17&18, 19&20, 21&22, 23&24, 25&26, 27&28, 29&30 between binding to spaced-apart top warp yarns 15 and 31 and provides segment 4 consisting of transitional warp 29 and interlacings with warps 31,33,35. Thus binder yarn I2 provides 2 paper side segments of 4 warps, a binding under another segment and a binder stiffening section of 7 warp pairs largely under another segment.

From the above discussion, it should be apparent that interchanging binder yarns I1 and I2 in pair 16F cooperate to provide 4 segments, 3 of which are bound by an underlying interlacing of a binder yarn with a single wear side warp yarn. The remaining segment is "stiffened" to thereby increase the fabric CD bending stiffness and so optimize sheet basis weight profiles.

Interchanging binder yarns I1 and I2 in pair 16F are illustrative of the weave pattern of only half of the interchanging binder pairs, the difference being that in the other one-half of the interchanging binder pairs, e.g., 18F, a binder stiffening section of only 5 warp pairs is provided. Therefore, alternating binder pairs include a binder stiffening section of 7 warp pairs and 5 warp pairs, respectively.

In fabric 70, the segments provided by the respective yarns of each binder pair are of unequal length and the insertion order is reversed in adjacent pairs such that the binders providing the segments of different length are inserted in reverse order. In this way the binder providing the stiffening section is always inserted last. In fabric 70 the full weave repeat requires 20 paper side weft yarns, 20 wear side weft yarns and 20 pairs of interchanging binder yarn pairs. In accordance with this invention, the fabric 70 may also be woven with the binders providing the binder stiffening sections being inserted alternately first and second, if desired.

Figure 8:
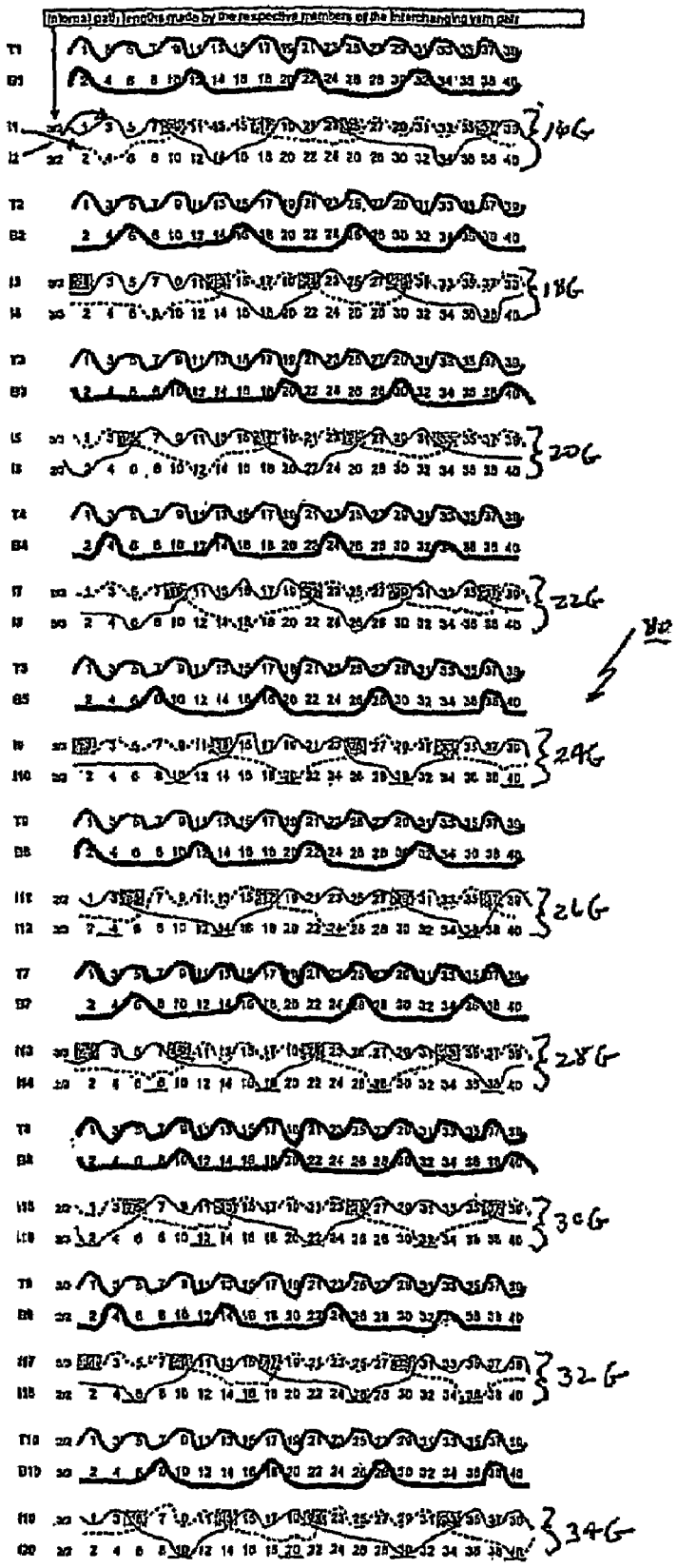
FIG. 8 shows the weave paths for all paper side wefts, wear side wefts, and interchanging binder yarn pairs of a second 40 shaft fabric in accordance with this invention.

Referring to FIG. 8, an eighth embodiment of a fabric of this invention, which has a 40 shaft repeat, is fully illustrated at 80. A first intrinsic interchanging weft binder pair employed in the fabric 80 is designated at 16G. The remaining binder pairs in the full weave pattern are of the same weave structure, as is clearly illustrated in FIG. 8.

In FIG. 8, the 10 paper side wefts T1,T2,T3 . . . T10 within the full weave repeat interlace with the 20 paper side warps 1,3,5 . . . 39 in "over one-under one sequence" such that each weft makes 10 repeats of plain weave within full weave repeat of the paper side warps. The 10 wear side wefts B1,B2 . . . B10 within the full weave repeat interlace with the 20 wear side warps 2,4,6 . . . 40 in a 5 shaft sequence, e.g., "over one-under 4 sequence" to make 4 repeats of 5 shaft within the full weave repeat of the wear side warps. The 10 interchanging binder pairs 16G, 18G . . . 34G within each weave repeat interlace with the 20 paper side and 20 wear side warps such that the full fabric weave repeat requires 40 warp yarns.

Binder I1 in pair 16G is represented by the dotted line and weaves as follows: it binds with wear side warp 4 under segment 1, it provides segment 2 consisting of transitional warp 9 and interlacings with paper side warps 11,13,15, it provides a binder stiffening section predominantly located in the sub-layer under segment 3, by floating between warp pairs 17&18, 19&20, 21&22, 23&24, 25&26 between binding to top warp yarns 15 and 27 to thereby enhance fabric CD bending stiffness, and it provides segment 4 consisting of transitional warp 25 and interlacings with warps 27,29,31,33, 35. Thus binder yarn I1 provides 2 paper side segments (i.e., 2 and 4) of 4 and 6 warps duration, respectively, a binder stiffening section of 5 warp pairs duration predominately under another paper side segment and a binding to a single bottom warp yarn under yet another paper side segment.

Binder I2 in pair 16G is represented by the solid line and weaves as follows: it provides segment 1 consisting of transitional warp 37 and interlacings with paper side warp yarns 39, 1, 3, 5, 7, it binds with wear side warp 14 under segment 2, it provides paper side segment 3 consisting of transitional warp 17 and interlacings with paper side warp yarns 19, 21, 23 and it binds with wear side warp 34 under segment 4. Thus binder I2 provides 2 paper side segments of 6 and 4 warps duration, respectively, and provides a binding to a single bottom warp yarn under each of the other two segments.

Thus, it should be apparent that the interchanging binder yarns I1 and I2 in pair 16G cooperate to provide 4 segments, 3 of which have an underlying wear side warp yarn that is bound by the interlacing of a binder yarn therewith. The remaining segment is "stiffened" to thereby increase the fabric CD bending stiffness and thereby optimize sheet basis weight profiles.

Interchanging binder yarns I1 and I2 in pair 16G are illustrative of the weave relationship of the interchanging binder yarns in all of the other interchanging binder pairs in the fabric 80. That is, the respective members of each binder pair provide two segments of different lengths. The different length segments are repeated in each interchanging binder weft. However, as illustrated, the insertion order is reversed from pair to pair such that the binders providing the segments of different length are inserted in reverse order. In this way the binder providing the stiffening section is inserted alternately first and last. However, it is within the scope of this invention not to reverse the insertion order, in which case the binder stiffening sections will always be inserted either first or second. As is clearly shown in FIG. 8, the full weave repeat requires 10 paper side weft yarns, 10 wear side weft yarns and 10 pairs of interchanging binder pairs.

Figure 9:
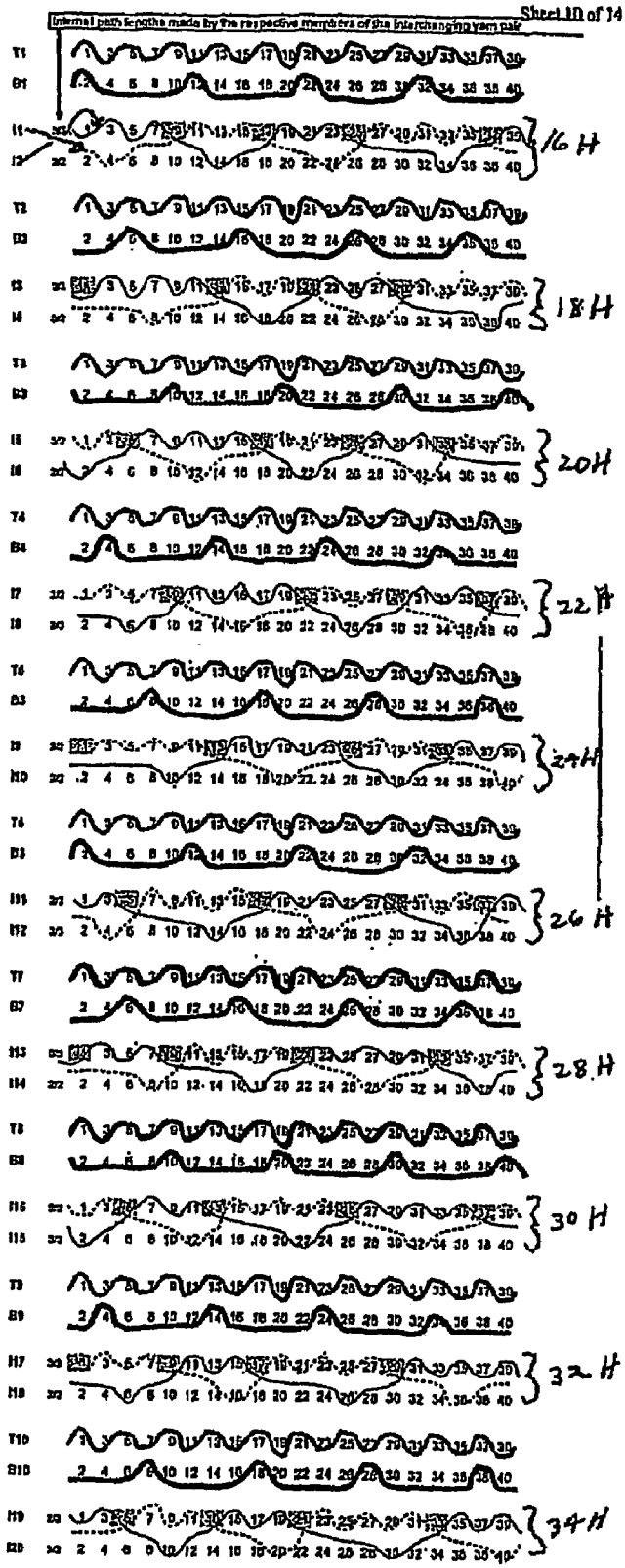
FIG. 9 shows the weave paths for all paper side wefts, wear side wefts, and interchanging binder yarn pairs of a third 40 shaft fabric in accordance with this invention.

Referring to FIG. 9, a ninth embodiment of a fabric of this invention is fully illustrated at 90. A first intrinsic interchanging weft binder pair employed in the fabric 90 is illustrated at 16H. As shown in FIG. 9, all of the intrinsic interchanging weft binder pairs employed in this embodiment can be of the same weave repeat pattern as pair 16H. The fabric 90 is identical to the fabric 80 shown in FIG. 8 with exception that none of the interchanging binder weft pairs in fabric 90 provide a binder stiffening section to enhance fabric bending stiffness. Instead, the interchanging binder pairs in fabric 90 provide an additional bound segment. Thus, in fabric 90 a bound, bottom warp underlies each of the four (4) top segments.

As can be seen in FIG. 9, the 10 paper side wefts T1,T2, T3 . . . T10 interlace with the 20 paper side warps 1,3,5 . . . 39 in an "over one-under one sequence," such that each paper side weft makes 10 repeats of plain weave in the fabric 90. As also can be seen in FIG. 9, the fabric 90 includes 10 wear side wefts B1, B2 . . . B10 that interlace with the 20 wear side warps 2,4,6 . . . 40 in an "over one-under 4 sequence" to make 2 repeats of 5 shaft. Fabric 90 also includes 10 interchanging binder pairs 16H, 18H . . . 34H that interlace with the 20 paper side and 20 wear side warps such that the full fabric weave repeat requires 40 warp yarns.

Binder I1 in pair 16H is represented by the dotted line and weaves as follows: it binds with wear side warp 4 under segment 1, it provides segment 2 consisting of transitional warp 9 and interlacings with warps 11, 13, 15, it binds with wear side warp 24 under segment 3 to thereby enhance fabric delamination resistance and it provides segment 4 consisting of transitional warp 25 and interlacings with warps 27, 29, 31, 33, 35. Thus, binder I1 provides 2 paper side segments of 4 and 6 warps duration (i.e., 2 weft knuckles and 3 weft knuckles), respectively, and binds under the other two segments 1 and 3.

Binder I2 in pair 16H is represented by the solid line and weaves as follows: it provides segment 1 consisting of transitional warp 37 and interlacings with paper side warp 39, 1, 3, 5, 7, it binds with wear side warp 14 under segment 2, it provides segment 3 consisting of transitional warp 17 and interlacings with paper side warp 19, 21, 23 and it binds with wear side warp 34 under segment 4. Thus, binder I2 provides 2 paper side segments of 6 and 4 warps duration (i.e., 3 knuckles and 2 knuckles, respectively) and binds under the other two segments 2 and 4.

From the above explanation it should be apparent that interchanging binder yarns I1 and I2 in pair 16H cooperate to provide 4 segments, all of which are bound in their sub-regions by the interlacing of a binder yarn with a single wear side warp yarn.

Interchanging binder yarns I1 and I2 in pair 16H are illustrative of the weave arrangement of the interchanging binder yarns in the other interchanging binder pairs in the fabric 90, which are all illustrated in FIG. 9. The respective yarns of each binder pair provide two segments of unequal length and equal numbers of interlacings with the wear side and paper side warp yarns. However, the internal paths of the respective binders are noticeably different with each binder of a pair floating between different numbers of warp pairs, such that two distinct binder groups can be identified. The knuckles of the binders in each group form twill lines. The binder pairs may be inserted in reverse such that the distance between binder knuckles on a twill line changes and the twill line becomes somewhat broken up.

As is also shown in FIG. 9, the full weave repeat in fabric 90 requires 10 paper side wefts, 10 wear side wefts and 10 pairs of interchanging binder pairs. However, in accordance with the broadest aspects of this invention, the fabric 90 also can be woven such that the binder pairs are not inserted in a reversing sequence.

Figure 10:
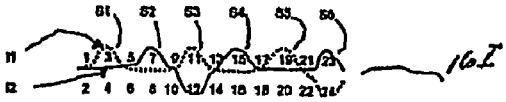
FIG. 10 shows the weave paths of a pair of intrinsic, interchanging weft binder yarns that can be employed in a first 24 shaft fabric in accordance with this invention.

Referring to FIG. 10, an intrinsic interchanging weft binder pair 16I that can be employed in another, 24 shaft embodiment of this invention is illustrated. Unlike the embodiments already disclosed, this embodiment has interchanging binder weft pairs which provide 6 segments incorporating 12 paper side warps and 12 wear side warps in a 24 shaft weave repeat. All of the intrinsic interchanging weft binder pairs employed in this embodiment can be of a similar weave structure to pair 16I; each providing 6 segments. Binder I1 in pair 16I is represented by the dotted line and weaves as follows: it provides segment 1 consisting of transitional warp 1 and an interlacing with warp 3, it provides a binder stiffening section predominantly located in the sub-layer underlying segment 2 by floating between warp pairs 5&6, 7&8, 9&10 between binding to top warp yarns 3 and 11 to thereby enhance fabric CD bending stiffness, it provides segment 3 consisting of transitional warp 9 and an interlacing with warp 11, it provides a further binder stiffening section predominantly located in the sub-layer underlying segment 4 by floating between warp pairs 13&14, 15&16, 17&18 between binding to top warp yarns 11 and 19 to thereby further enhancing fabric CD bending stiffness, it provides segment 5 consisting of transitional warp 17 and an interlacing with warp 19 and it binds with wear side warp 24 under segment 6. Thus I1 provides 3 paper side segments each of 2 warps duration (i.e., segments 1, 3 and 5), 2 binder stiffening sections each of three warp pairs duration underlying segments 2 and 4, respectively, and binding under the other segment; namely segment 6.

Binder I2 in the pair 16I is represented by the solid line and weaves as follows: it provides a first binder stiffening section predominantly located in the sub-layer of segment 1 by floating between warp pairs 1&2, 3&4, 5&6 between binding to top warp yarns 23 and 7, respectively, to thereby enhance fabric CD bending stiffness, it provides segment 2 consisting of transitional warp 5 and an interlacing with paper side warp 7, it binds with wear side warp 12 under segment 3, it provides segment 4 consisting of transitional warp 13 and an interlacing with paper side warp 15, it provides a second binder stiffening section predominantly located in the sub-layer under segment 5 by floating between warp pairs 17&18, 19&20, 21&22 between binding to top warp yarns 15 and 23 and it provides segment 6 consisting of transitional warp 21 and an interlacing with paper side warp 23. Thus binder I2 provides 3 paper side segments each of 2 warps duration (segments 2, 4 and 6), 2 binder stiffening sections each of three warp pairs duration underlying segments 1 and 5, and a binding to one bottom, or wear side warp yarn under the other segment; namely segment 3.

From the above explanation it should be apparent that interchanging binder yarns I1 and I2 in pair 16I cooperate to provide 6 segments, which are all of equal duration, i.e., 2 paper side warp yarns. Of the 6 segments only two of these have a binder interlacing with a single wear side warp yarn in their sub-regions. The two bound segment sub-regions are spaced apart and each are separated by 2 intervening segments. Moreover, the 4 segments that do not have an underlying binding to a bottom warp yarn include binder stiffening sections to enhance the CD stiffness of the fabric.

The weave relationship in binder yarns I1 and I2 of pair 16I is illustrative of all other interchanging binder pairs in the fabric, which is indicated generally by the numeral 100. That is each interchanging binder pair cooperates to form 6 segments, each having a 2 paper side warp duration, with a binder stiffening section under 4 of the 6 segments and two bound bottom warp yarns located under separate segments that have 2 intervening segments between them.

In accordance with the broadest aspects of this invention, six (6) segment embodiments of the invention are not limited to weave structures in which bottom warp yarns underlying only a limited number of spaced apart, top segments are bound, e.g., embodiments may have one or more bottom warp yarns in sub-regions underlying 3, 4, 5 or all 6 segments that are bound by the interlacings of a binder with one or more of such bottom warps in each such sub-region. Furthermore, the six segment fabrics of this invention are not limited to structures wherein the segment length, or duration, is 2 warp yarns or wherein all segments are of equal length, or duration.

Although not shown in FIG. 10, the top weft yarns weave in a plain weave repeat, as in the previously disclosed embodiments. Thus, with such a weave pattern there are seven (7) repeats within the 24 shaft weave repeat of the fabric.

Suitable weaves of the non-interchanging bottom weft yarns for the wear side of fabric 100 include 4 shaft weaves, 6 shaft weaves, and 12 shaft weaves. That is, the bottom weft yarns weave under 3 bottom warp yarns and over 1 bottom warp yarn in the 4 shaft weave; under 5 bottom warp yarns and over 1 bottom warp yarn in the 6 shaft weave and under 11 bottom warp yarns and over 1 bottom warp yarn, or other suitable arrangement, in the 12 shaft repeat.

Figure 11:
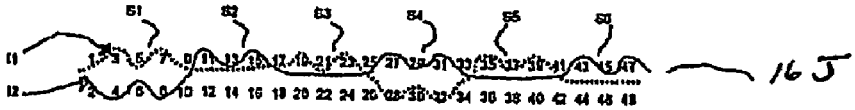
FIG. 11 shows the weave paths of another pair of intrinsic, interchanging weft binder yarns that can be employed in a first 48 shaft fabric in accordance with this invention.

Referring to FIG. 11 an intrinsic interchanging weft binder pair 16J in an eleventh embodiment of this invention is shown. Unlike the previously disclosed embodiments this embodiment has interchanging binder weft pairs that provide 6 segments incorporating 24 paper side warps and 24 wear side warps in a 48 shaft weave repeat. All of the intrinsic interchanging weft binder pairs employed in this embodiment can be of the same weave structure as pair 16J.

Binder I1 in pair 16J is represented by the dotted line and weaves as follows: it provides segment 1 consisting of transitional warp 1 and interlacings with warps 3,5,7, it provides a binder stiffening section of 5 warp pair duration predominantly located in the region of the sub-layer underlying segment 2 by floating between warp pairs 9&10, 11&12, 13&14, 15&16, 17&18 between binding to top warp yarns 7 and 19 to thereby enhance fabric CD bending stiffness, it provides segment 3 consisting of transitional warp 17 and interlacings with warps 19,21,23, it binds with wear side warps 28 and 32 under segment 4, it provides segment 5 consisting of transitional warp 33 and interlacings with warps 35,37,39 and it provides a further binder stiffening section, again of 5 warp pair duration, predominantly located in the region of the sub-layer underlying segment 6 by floating between warp pairs 41&42, 43&44, 45&46, 47&48 and 1&2 between binding to top warp yarns 39 and 3 to thereby further enhance fabric CD bending stiffness. Thus binder yarn I1 provides 3 paper side segments (i.e., 1, 3 and 5) each of 4 warps duration, 2 binder stiffening sections each of 5 warp pairs duration underlying segments 2 and 6, respectively, and binds to two separate warp yarns under the other segment (i.e., segment 4).

Binder I2 in pair 16J is represented by the solid line and weaves as follows: it binds with wear side warps 4 and 8 under segment 1, it provides segment 2 consisting of transitional warp 9 and interlacings with paper side warps 11, 13, 15, it provides a first binder stiffening section predominantly located in the region of the sub-layer underlying segment 3 by floating between warp pairs 17&18, 19&20, 21&22, 23&24, 25&26 between binding to top warp yarn 15 and 27 to thereby enhance fabric CD bending stiffness, it provides segment 4 consisting of transitional warp 25 and interlacings with paper side warps 27, 29, 31, it provides a second binder stiffening section predominantly located in the sub-layer underlying segment 5 by floating between warp pairs 33&34, 35&36, 37&38, 39&40, 41&42 between binding to top warp yarn 31 and 43, it provides segment 6 consisting of transitional warp 41 and interlacings with paper side warp 43, 45, 47. Thus, binder I2 provides 3 paper side segments each of 4 warp yarn duration (i.e., segments 2, 4 and 6), 2 binder stiffening sections each of five warp pairs duration underlying segments 3 and 5, respectively, and bindings to two separate warps under the remaining segment; namely segment 1.

From the above explanation, it should be apparent that Interchanging binder yarns I1 and I2 in pair 16J cooperate to provide 6 segments, all of equal duration, i.e., 4 paper side warp yarns. Moreover, of the 6 segments only two of these have binder interlacing with wear side warp yarns underlying them in their sub-regions (i.e., the interlacings underlie segments 1 and 4, respectively). In addition, the two bound yarns underlie paper side segments that are spaced apart and separated from each other by 2 intervening segments. In addition, there are binder stiffening sections underlying 4 of the 6 paper side segments, i.e., segments 2, 3, 5 and 6. As noted, the binder stiffening sections are arranged in contiguous pairs, each pair underlying contiguous paper side segments and each pair being separated from the other pair by a paper side segment that does not have an underlying binder stiffening section.

Interchanging binder pair 16J is illustrative of the weave pattern that can be employed in the other interchanging binder pairs within the weave repeat. That is, each of the interchanging binder yarn pairs can have 6 equal-length segments of 4 paper side warp yarns each; binder interlacings with two wear side warp yarns under each of two segments that are spaced apart from each other by 2 intervening segments, and binder stiffening sections underlying 4 of the 6 paper side segments, said binder stiffening sections being arranged in contiguous pairs underlying adjacent paper side segments, with each pair being spaced from the other pair by a single paper side segment that does not have an underlying binder stiffening section.

Although not illustrated, the non-interchanging top weft yarns can form a plain weave pattern in the top layer, in the same manner as in the previously described embodiments of this invention. As is illustrated, the interchanging binder pairs also cooperate to provide a plain weave pattern in the top layer. However, it is within the scope of this invention to vary the weave pattern in the top layer. Therefore, in accordance with the broadest aspects of this invention the weave pattern in the top layer is not required to be a plain weave.

Suitable weaves for the non-interchanging weft yarns in the wear side of the fabric include 4 shaft weaves (e.g., under 3 contiguous bottom warps and over 1), 6 shaft weaves (e.g. under 5 contiguous bottom warps and over 1), 8 shaft weaves (under 7 contiguous bottom warps and over 1 or, alternatively, under 5 contiguous bottom warps, over 1, under 1, and over 1) and 12 shaft weaves (under 11 contiguous bottom warps and over 1). The 4 shaft weave repeats 6 times within the full bottom warp weave repeat of 24 yarns; the 6 shaft weave repeats 4 times within the full bottom warp weave repeat of 24 yarns; the 8 shaft weave repeats 3 times within the full bottom warp weave repeat of 24 yarns and the 12 shaft weave repeats 2 times within the full bottom warp weave repeat of 24 yarn.

Figure 12:
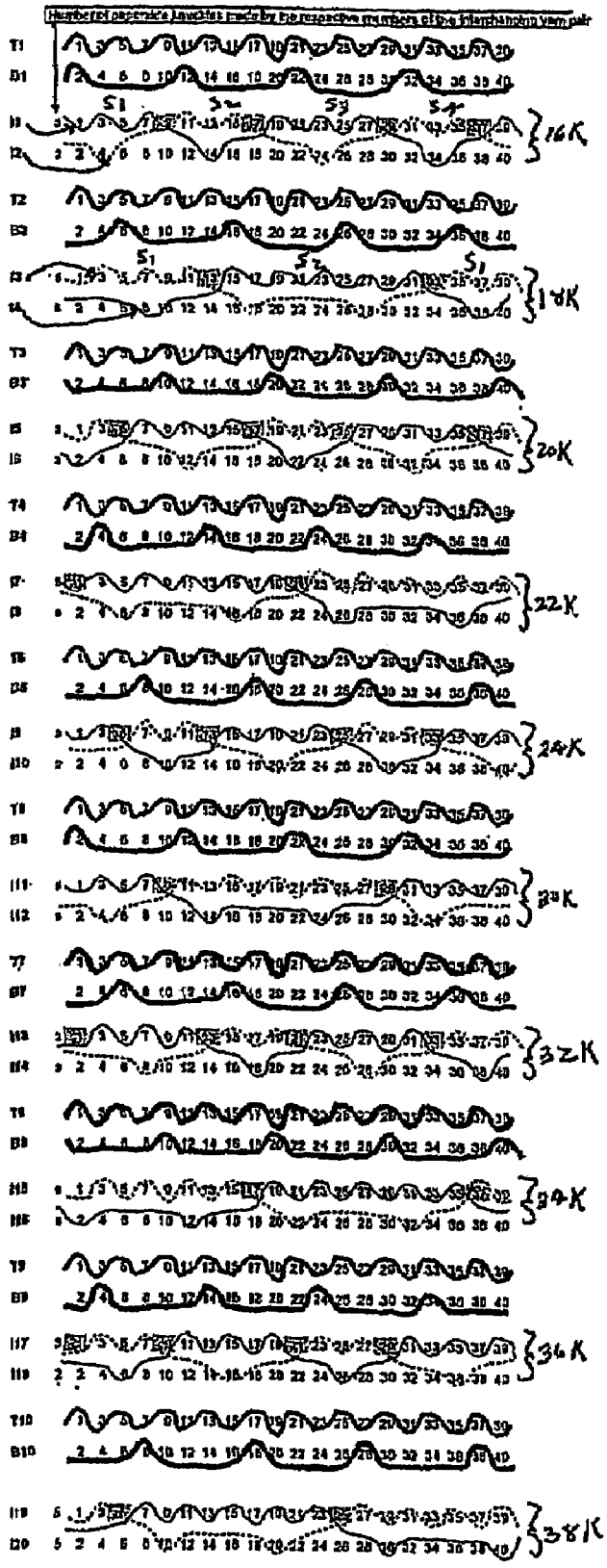
FIG. 12 shows the weave paths for all paper side wefts, wear side wefts, and interchanging binder yarn pairs of a fourth 40 shaft fabric in accordance with this invention.
Figure 12:
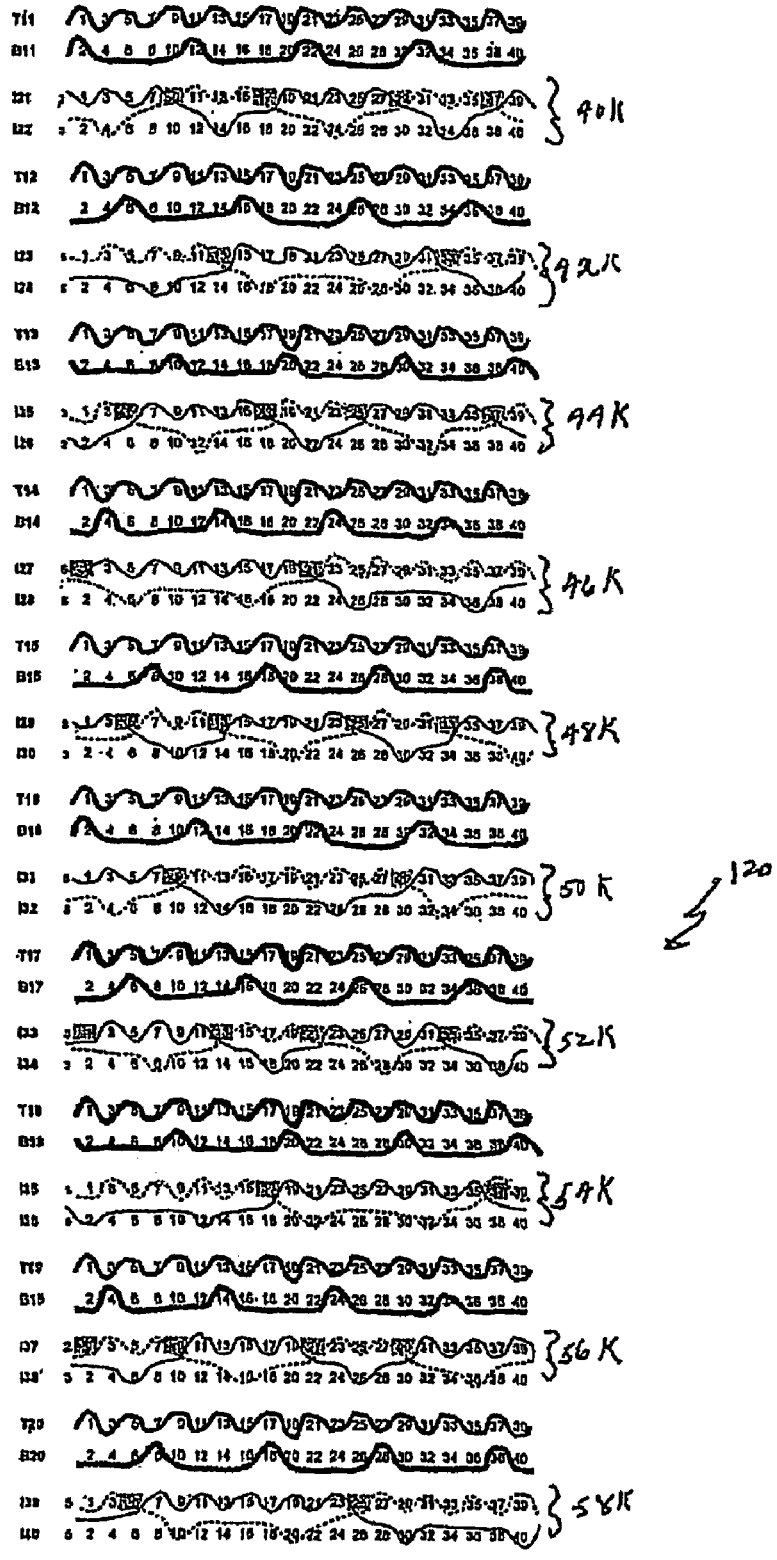

Referring to FIG. 12, a twelfth embodiment of a fabric of this invention is fully illustrated at 120 in a 40 shaft weave repeat (i.e., 20 top warp yarns and 20 underlying bottom warp yarns). A first intrinsic interchanging weft binder pair employed in the fabric 120 is illustrated at 16K and a second intrinsic interchanging weft binder pair, which provides a different weave pattern than the pair 16K, is illustrated at 18K. The remaining intrinsic interchanging weft binder pairs within the full weave repeat of the fabric 120 are illustrated at 20K, 22K, 24K . . . 58K.

As illustrated in the exemplary embodiment 120, and as will be explained in greater detail hereinafter, every other pair of interchanging binder yarns (e.g., 16K, 20K, 24K, etc.) provides 4 paper side segments which alternate between a duration, or length, of 6 top warp yarns and 4 top warp yarns, respectively, and the alternating pairs of interchanging binder yarns (e.g., 18K, 22K, 26K, etc.) have only 2 paper side segments, each of a duration, or length, of 10 top warp yarns. Although it is preferred that a substantial number of the interchanging binder yarn pairs provide 4 paper side segments within each full weave repeat, within the broadest aspects of this invention at least one of such interchanging binder yarn pairs is required to have at least 4 paper side segments within each full weave repeat. The remaining interchanging binder yarn pairs may have only 2 paper side segments within each weave repeat; however, this is not considered to be a very desirable structure within the scope of the present invention.

In the fabric 120 illustrated in FIG. 12 the 20 paper side wefts T1,T2,T3 . . . T20 within each full weave repeat interlace with the 20 paper side warps 1, 3, 5 . . . 39 in an "over one-under one sequence" such that each weft makes 10 repeats of plain weave. The 20 wear side wefts B1, B2 . . . B20 within each full weave repeat interlace with the 20 wear side warps 2, 4, 6 . . . 40 in an "over one-under 4 sequence" (e.g., a 5 shaft repeat) to make 4 repeats of 5 shaft within the 20 wear side warp yarn weave repeat. The 20 interchanging binder pairs 16K, 18K . . . 54K within each weave repeat interlace with the 20 paper side and 20 wear side warps, such that the full fabric weave repeat requires 40 warp yarns.

Binder I1 in pair 16K is represented by the solid line and weaves as follows: it provides segment 1 consisting of transitional warp 37 and interlacings with warps 39,1,3,5,7, it binds with wear side warp 14 under segment 2, it provides segment 3 consisting of transitional warp 17 and interlacings with warps 19, 21, 23, 25, 27 and it binds with wear side warp 34 under segment 4 to thereby provide 2, spaced-apart paper side segments 1 and 3 of 6 warps duration and to provide a binding under the other two segments 2 and 4.

Binder I2 in pair 16K is represented by the dotted line and weaves as follows: it binds with wear side warp 4 under segment 1, it provides segment 2 consisting of transitional warp 9 and interlacings with paper side warp 11, 13, 15, it binds with wear side warp 24 under segment 3 and it provides segment 4 consisting of transitional warp 29 and interlacings with warps 31, 33, 35 to thereby provide 2, spaced-apart paper side segments 2 and 4 of 4 warps duration each and to provide a binding under the other two segments 1 and 3.

From the above discussions it should be apparent that in the fabric 120 the interchanging binder yarns I1 and I2 in pair 16K cooperate to provide 4 segments, each of which has an underlying, wear side warp yarn that is bound by the interlacing of a binder yarn therewith to thereby ensure good resistance to delamination of the two fabric layers.

As illustrated, interchanging binder pair 16K has a weave pattern that is illustrative of only half of the pairs in the full weave repeat. The other half of the interchanging binder pairs have the weave repeat illustrated in binder pair 18K. In particular, the interchanging binder yarns I3/I4 in the binder pair 18K co-operate to provide only two paper side segments within each full weave repeat of the warp yarns to minimize undesired sheet wire marks created from fabric transitional warps. Furthermore, as will be explained in greater detail hereinafter, the binder pair members I3/I4 each provide a binder stiffening section of 4 warp pairs duration underlying each of the two paper side segments to enhance sheet basis weight profiles.

Still referring to FIG. 12, binder 13 in the interchanging binder pair 18K is represented by the dotted line and weaves as follows: it provides segment 1 consisting of transitional warp 33 and interlacings with paper side warps 35, 37, 39, 1, 3, 5, 7, 9, 11, and it binds with wear side warps 18 and 28 under segment 2 to thereby provide a binder stiffening section of 4 warp pairs duration between the bound wear side warps 18 and 28. Binder I4 in the interchanging binder pair 18K is represented by the solid line and weaves as follows: it provides segment 2 consisting of transitional warp 13 and interlacings with paper side warps 15, 17, 19, 21, 23, 25, 27, 29, 31, and it binds with wear side warps 38 and 8 under segment 1 to thereby provide a binder stiffening section of 4 warp pairs duration between the wear side warps 38 and 8.

From the above explanation it should be apparent that the Interchanging binder yarns I3 and I4 in pair 18K of the fabric 120 cooperate to provide 2 segments, each of which has two, single, spaced-apart underlying wear side warp yarns that are bound by the interlacing of a binder yarn to thereby provide good cross-machine direction stiffness and ensure good fabric delamination resistance.

It should be noted that many modifications can be made within the scope of this invention. For example the type (e.g., material), diameter and shape of the yarns can be varied. A number of variations also can be made in the weave patterns. For example, it is not required that the top weave pattern be the plain weave pattern depicted in all of the embodiments. Also, the order of insertion of the yarns of the interchanging binder yarn pairs can be varied, and it is not a requirement of the invention that alternate pairs of interchanging yarns be reversed, even when the segment lengths provided by the interchanging binder yarns are different. In addition, although specific weave repeats have been illustrated, other weave repeats can be employed in accordance with the broadest aspects of this invention. The ratio of top-to-bottom effective weft paths also can be varied, e.g., 1:1; 2:1 (as shown in all of the embodiments) 3:2, 4:3, etc. In addition, although the illustrated embodiments of this invention have the same number of top and bottom warp yarns within each repeat, actually in vertical alignment, i.e., a 1:1 ratio of top-to-bottom warp yarns, it is within the scope of this invention to include a different number of warp yarns in the top and bottom layers, respectively. For example, a 2:1 relationship can be provided between the number of warp yarns in the top layer and the number of warp yarns in the bottom layer, e.g., 28 top warp yarns and 14 bottom warp yarns within each repeat; thereby providing a 42 warp yarn repeat.

It also should be noted that in describing the various embodiments that include binder stiffening sections, it was stated that those stiffening sections underlie specified segments. In actuality, in addition to underlying the specified segments, a number of the stiffening sections also partially underlie an adjacent segment. This is readily apparent from the drawings forming a part of this application and therefore no further explanation of this feature is necessary.

Without further elaboration, the foregoing will so fully illustrate my invention that others may, by applying current or future knowledge; readily adopt the same for use under various conditions of service.

The invention claimed is:

1. A composite forming fabric comprising a paper side layer having a paper side surface, a machine side layer having a bottom wear side surface, and a plurality of pairs of first and second intrinsic, interchanging weft yarns at least interweaving with the paper side layer, wherein the paper side layer and the machine side layer each comprise warp yarns and non-interchanging weft yarns woven together; said paper side layer and said machine side layer each having a predetermined repeat of the weave pattern in the cross-machine direction; at least one of said plurality of pairs of first and second intrinsic, interchanging weft yarns having at least four segments in the paper side layer within each repeat of the weave pattern, said segments providing an unbroken weft path in the paper side surface, with each succeeding segment being separated in the paper side surface of the paper side layer by at least one paper side layer transitional warp yarn, the yarns of said intrinsic, interchanging weft pairs are both binder wefts or one of the interchanging yarns is a binder weft and the other is a top weft in the weave pattern.

2. A composite forming fabric according to claim 1, wherein at least one of said four segments has a different length from the remaining segments.

3. A composite forming fabric according to claim 1, wherein the paper side layer further comprises warp yarns, interchanging weft yarn pairs and non-interchanging weft yarns woven together.

4. A composite forming fabric according to claim 1, wherein said interchanging intrinsic weft yarn pairs are disposed between adjacent pairs of paper side weft yarns.

5. A composite forming fabric according to claim 1, wherein the paper side layer only comprise warp yarns and interchanging weft yarn pairs woven together.

6. A composite forming fabric according to claim 1, wherein each of said first and second intrinsic, interchanging weft binder yarns of each pair of yarns having at least four segments in the paper side layer within each repeat of the weave pattern binds to at least one warp yarn in the machine side layer vertically underlying one of said segments.

7. A composite forming fabric according to claim 1, wherein at least one of the paper side segment sub-layers has no interlacing between either member of said intrinsic interchanging weft binder pair and the machine side warp yarns.

8. A composite forming fabric according to claim 1, wherein at least two or all of said at least four segments per weave repeat have underlying sub-surface binder yarn and wear side warp yarn interlacing.

9. A composite forming fabric according to claim 1, wherein per weave repeat said pairs of intrinsic, interchanging weft binder yarns bind to a single wear side warp yarn in regions underlying two segments.

10. A composite forming fabric according to claim 1, wherein the weave repeat includes two adjacent segments that are free of any underlying, bound wear side warp yarns.

11. A composite forming fabric according to claim 1, wherein all of said pairs of intrinsic, interchanging weft binder yarns having at least four segments in the paper side layer within each repeat of the weave pattern.

12. A composite forming fabric according to claim 1, wherein the second member of said pair of intrinsic interchanging binder yarns per weave repeat has less segment underlying sub-surface binder yarn and wear side warp yarn interlacing as the first member of said pair of intrinsic interchanging binder yarns.

13. A composite forming fabric according to claim 1, wherein the second member of said pair of intrinsic interchanging pair per weave repeat binds under less segments with wear side warp yarns than the fist member of said pair.

14. A composite forming fabric according to claim 1, wherein at least one intrinsic interchanging weft yarn pair have a different number of segments within each weave repeat.

15. A composite forming fabric according to claim 1, wherein at least one of said binders of said pair of interchanging intrinsic pair floats between the paper side and machine side warp yarns in the region of a segment created by the other binder of said pair.

16. A composite forming fabric according to claim 1, wherein the fabric has a weave repeat comprising at least 24 warp yarns.

17. A composite forming fabric according to claim 1, wherein the fabric has a paper side to machine side warp yarn ratio of 1:1.3:2.2:1 or higher.

* * * * *